US008893693B2

(12) United States Patent
Hijii et al.

(10) Patent No.: US 8,893,693 B2
(45) Date of Patent: Nov. 25, 2014

(54) INTERNAL COMBUSTION ENGINE AND METHOD OF PRODUCING SAME

(75) Inventors: Takumi Hijii, Toyota (JP); Naoki Nishikawa, Miyoshi (JP); Akio Kawaguchi, Shizuoka-ken (JP); Koichi Nakata, Mishima (JP); Yoshifumi Wakisaka, Nagoya (JP); Hidemasa Kosaka, Nisshin (JP); Fumio Shimizu, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 140 days.

(21) Appl. No.: 13/817,966

(22) PCT Filed: Aug. 23, 2011

(86) PCT No.: PCT/IB2011/001924

§ 371 (c)(1), (2), (4) Date: Feb. 20, 2013

(87) PCT Pub. No.: WO2012/025812

PCT Pub. Date: Mar. 1, 2012

(65) Prior Publication Data

US 2013/0146041 A1 Jun. 13, 2013

(30) Foreign Application Priority Data

Aug. 25, 2010 (JP) ..... 2010-188450

(51) Int. Cl.

| | |
|---|---|
| ***F02B 75/08*** | (2006.01) |
| ***F02F 3/00*** | (2006.01) |
| ***C25D 5/02*** | (2006.01) |
| ***C25D 7/06*** | (2006.01) |

(52) U.S. Cl.
USPC ..... 123/668; 29/888.048; 29/888.061; 205/122; 205/151

(58) Field of Classification Search
USPC ..... 123/193.1, 193.2, 193.4, 668; 29/888.01, 888.045, 888.048, 888.061; 205/122, 151
See application file for complete search history.

(56) References Cited

U.S. PATENT DOCUMENTS

| | | | |
|---|---|---|---|
| 6,066,392 | A | 5/2000 | Hisamoto et al. |
| 2012/0042859 | A1 | 2/2012 | Sakai |

FOREIGN PATENT DOCUMENTS

| | | | |
|---|---|---|---|
| EP | 2 175 116 | A1 | 4/2010 |
| JP | 63-206499 | A | 8/1988 |
| JP | 11-140690 | A | 5/1999 |
| JP | 2000-109996 | A | 4/2000 |
| JP | 2003-113737 | A | 4/2003 |
| JP | 2006-124827 | A | 5/2006 |
| JP | 2009-243352 | A | 10/2009 |
| JP | 2009-243355 | A | 10/2009 |
| JP | 2010-249008 | A | 11/2010 |
| WO | 2009/020206 | A1 | 2/2009 |

*Primary Examiner* — Noah Kamen
(74) *Attorney, Agent, or Firm* — Sughrue Mion, PLLC

(57) ABSTRACT

An internal combustion engine in which an anodic oxidation coating film is formed on all or a portion of a wall that faces a combustion chamber, wherein the anodic oxidation coating film has a structure that is provided with a bonding region in which each of hollow cells forming the coating film is bonded to the adjacent hollow cells, and a nonbonding region in which three or more adjacent hollow cells are not bonded to each other, and wherein a porosity of the anodic oxidation coating film is determined by a first void present in the hollow cell and a second void that forms the nonbonding region.

15 Claims, 18 Drawing Sheets

(AFTER THE ANODIC OXIDATION TREATMENT)

(SURFACE) (BOTTOM SIDE)

(COMPARATIVE EXAMPLE)

(AFTER THE ANODIC OXIDATION TREATMENT)

(SURFACE) (BOTTOM SIDE)

(EXAMPLE)

(AFTER THE ACID-BASED PORE WIDENING TREATMENT)

(SURFACE) (BOTTOM SIDE)

(COMPARATIVE EXAMPLE)

(AFTER THE ACID-BASED PORE WIDENING TREATMENT)

(SURFACE) (BOTTOM SIDE)

(EXAMPLE)

CROSS SECTION OF THE COMPARATIVE EXAMPLE ANODIC OXIDATION COATING FILM

COMPARATIVE EXAMPLE 1
(POROSITY: 3.0%)

COMPARATIVE EXAMPLE 2
(POROSITY: 9.2%)

COMPARATIVE EXAMPLE 3
(POROSITY: 13.4%)

EXAMPLE 1
(POROSITY: 25.6%)

EXAMPLE 2
(POROSITY: 31.5%)

EXAMPLE 3
(POROSITY: 20.1%)

EXAMPLE 4
(POROSITY: 33.8%)

COMPARATIVE EXAMPLE 4
(POROSITY: 41.3%)

COMPARATIVE EXAMPLE 5
(POROSITY: 43.0%)

(NO PORE WIDENING TREATMENT)

(20 MINUTES PORE WIDENING TREATMENT)

(40 MINUTES PORE WIDENING TREATMENT)

INTERNAL COMBUSTION ENGINE AND METHOD OF PRODUCING SAME

INCORPORATION BY REFERENCE

The disclosure of Japanese Patent Application No. 2010-188450 filed on Aug. 25, 2010, including the specification, drawings and abstract is incorporated herein by reference in its entirety.

BACKGROUND OF THE INVENTION

1. Field of the Invention

The invention relates to an internal combustion engine and a method of producing this internal combustion engine. More particularly, the invention relates to an internal combustion engine in which an anodic oxidation coating film is formed on all or a portion of the wall facing a combustion chamber of the internal combustion engine and relates to a method of producing an internal combustion engine having a feature in forming this anodic oxidation coating film.

2. Description of the Related Art

An internal combustion, engine, e.g., a gasoline engine or diesel engine, is composed primarily of an engine block and a cylinder head, and its combustion chamber is defined by the bore surface of the cylinder block, the top surface of the piston installed in this bore, the bottom surface of the cylinder head, and the head surfaces of the intake and exhaust valves that are disposed in the cylinder head. Accompanying the higher outputs being required of internal combustion engines at the present time, it has become crucial to lower their cooling losses. One strategy for lowering this cooling loss is to form a heat-insulating ceramic coating film on the inner wall of the combustion chamber.

However, these ceramics generally have a low thermal conductivity and have a high heat capacity, causing the appearance of a reduced intake efficiency and knocking (abnormal combustion caused by heat being retained within the combustion chamber), and as a consequence at the present time their use as a coating film material on the interior walls of the combustion chamber is not spreading.

In view of the preceding, the heat-insulating coating film formed on the wall of the combustion chamber must certainly be heat resistant and heat insulating and is desirably formed from a material that has a low thermal conductivity and a low heat capacity. Moreover, in addition to this low thermal conductivity and low heat capacity, the coating film is desirably formed from a material that can Withstand the expansion pressure and injection pressure during combustion in the combustion chamber and the repetitive stresses from thermal expansion and thermal shrinkage and is also desirably formed from a material that has a high adherence to the base material of, e.g., the cylinder block and so forth.

When one considers the conventional disclosed technology here, the cylinder head disclosed in Japanese Patent Application Publication No. 2003-113737(JP-A-2003-113737) has a microporous silicon dioxide-type or aluminum oxide-type coating film formed by anodic oxidation on both the bottom surface of the cylinder head and the inner surface of a water jacket that is defined within this cylinder head. Through the disposition in this cylinder head of the microporous coating film on both the bottom surface of the head and the inner surface of the jacket, the surface area of the bottom surface of the head and the jacket inner surface is enlarged by this coating film, and as a result the heat produced in the combustion chamber can be efficiently absorbed into the interior across the coating film and the inwardly absorbed heat can be efficiently discharged across the coating film at the jacket inner surface into the coolant. As a consequence, heating readily occurs through heat absorption while cooling readily occurs through heat release, resulting in a cylinder head for which a temperature increase is suppressed.

The internal combustion engine disclosed in Japanese Patent Application Publication No. 2009-243352 (JP-A-2009-243352) and WO 2009/020206 has a heat-insulating thin film in which bubbles are formed in the interior of a material that has a thermal conductivity lower than that of the base material forming the combustion chamber of the internal combustion engine and that has a heat capacity that is the same as or lower than that of the base material.

The art disclosed in the previously described JP-A-2003-113737, JP-A-2009-243352, and WO 2009/020206 is an art in which a coating film having a low thermal conductivity and a low heat capacity is formed on the inner wall of the combustion chamber of the internal combustion engine, and can provide heat-insulating coating films that exhibit excellent properties as described above.

However, it is not clear whether these coating film structures provide coating films that can withstand the expansion pressure and injection pressure during combustion in the combustion chamber and the repetitive stresses from thermal expansion and thermal shrinkage, or can provide coating films that can relax these pressures and stresses. The inventors found that it would be difficult to say that these coating film structures have an excellent pressure relaxing or stress relaxing behavior. One reason for this is that a coating film produced by anodic oxidation has a microstructure in which the constituent cells have voids in the interior while adjacent cells are almost gaplessly chemically bonded to each other, and as a result it is difficult to set up a satisfactory stress relaxation between these cells.

SUMMARY OF THE INVENTION

The invention was pursued in view of the problems identified above and provides an internal combustion engine that is equipped, on all or a portion of a wall that faces a combustion chamber, with an anodic oxidation coating film that has a low thermal conductivity and a low heat capacity and that exhibits an excellent ability to relax the expansion pressure and injection pressure during combustion in the combustion chamber and the repetitive, stresses from thermal expansion-shrinkage and that is therefore highly durable. The invention also provides a method of producing this internal combustion engine.

Therefore, according to a first aspect of the invention, an internal combustion engine is provided in which an anodic oxidation coating film is formed on all or a portion of a wall that faces a combustion chamber, wherein this anodic oxidation coating film has a structure that is provided with a bonding region in which each of hollow cells forming the coating film is bonded to the adjacent hollow cells, and a nonbonding region in which three or more adjacent hollow cells are not bonded to each other, and wherein a porosity of this anodic oxidation coating film is determined by a first void present in the hollow cell and a second void that forms the nonbonding region.

The internal combustion engine of the invention has an anodic oxidation coating film (or a heat-insulating film) on all or a portion of its combustion chamber. However, the internal combustion engine of the invention has a coating film that, unlike conventional anodic oxidation coating films, presents a microstructure that—in addition to the hollow cells having avoid (the first void) in their interior—has a void (the second void) that forms a nonbonding region at, for example, a triple point among adjacent hollow cells (Note: Polycrystalline metals are composed of a plurality of unit crystals (a plurality of cells here), which results in an adjacent relationship thereamong; when this occurs, the point at which three unit crystals coincide is called a triple point), while the bonding region, where the hollow cells are in contact with each other, has a chemically bonded structure.

Because the anodic oxidation coating film has voids, it has both a low thermal conductivity and a low heat capacity, but because it is also provided with a separate void (the second void) between/among cells while the hollow cells are also chemically bonded to each other; this coating film additionally has the ability to relax pressure, i.e., the expansion pressure and injection pressure during combustion in the combustion chamber, and the ability to relax the repetitive stresses from thermal expansion-shrinkage. In addition to the formation of a second void at all the triple points and so forth of three or more adjacent hollow cells constituting the coating film, this may be a film in which the second void is formed only at a portion of all the triple points and so forth.

The internal combustion engine of the invention may be directed to a gasoline engine or a diesel engine, and, with regard to its structure, as previously noted it is composed mainly of an engine block and a cylinder head. Its combustion chamber is defined by the bore surface of the cylinder block, the top surface of the piston installed in this bore, the bottom surface of the cylinder head, and the head surfaces of the intake and exhaust valves that arc disposed in the cylinder head.

The anodic oxidation coating film having the previously described microstructure may be formed over all of the wall facing the combustion chamber or may be formed only on a portion of this wall, and the latter case can be exemplified by embodiments such as only on the top surface of the piston or only on the valve head surface.

The base material forming the combustion chamber of the internal combustion engine can be exemplified by aluminum and its alloys and titanium and its alloys. An alumite coating film is formed when the anodic oxidation coating film is formed on a wall for which the base material is aluminum or an alloy thereof.

The mechanism for the fuel consumption improvement due to the formation of a low thermal conductivity low heat capacity anodic oxidation coating film (heat-insulating film) on the combustion chamber wall will be described with reference to FIG. 20. In an internal combustion engine, the surface temperature of the wall facing the combustion chamber is ordinarily constant and undergoes almost no variation during 1 cycle of intake compression combustion exhaust (the graph in FIG. 20 for the ordinary wall temperature); and the temperature difference versus the gas temperature (graph in FIG. 20 for the cylinder gas) constitutes a thermal loss. When, on the other hand, a low thermal conductivity low heat capacity insulating film is formed on the wall facing the combustion chamber, the temperature of the surface of the heat-insulating film varies during 1 cycle in a manner that tracks the variation in the combustion gas temperature (graph in FIG. 20 for the wall temperature of the heat-insulating film of the internal combustion engine of the invention). As a result, the temperature difference between the combustion gas temperature and the wall surface temperature is lower than in the absence of the heat-insulating film and the thermal loss is then reduced. This reduction in thermal loss converts to an increase in piston work and an increase in the exhaust temperature, and the increase in piston work is related to an improved fuel consumption. This Is material described in detail in the previously mentioned WO 2009/020206 by the inventors. The thickness of the aforementioned anodic oxidation coating film is preferably in the range from 100 to 500 μm.

According to the inventors, when the heat-insulating anodic oxidation coating film has a thickness below 100 μm, the temperature rise of the coating film surface during the combustion cycle is inadequate and the heat-insulating behavior becomes inadequate and an improvement in fuel consumption, described below, cannot be achieved. The minimum thickness is therefore set to 100 μm in order to secure this improvement in fuel consumption.

On the other hand, the inventors have also ascertained that when the thickness of the anodic oxidation coating film exceeds 500 μm, it takes on a large heat capacity at this point and the swing behavior (the property wherein the temperature of the anodic oxidation coating film tracks the gas temperature in the combustion chamber, while also providing a heat-insulating behavior) is impaired because the anodic oxidation coating film itself is then prone to store heat. 500 μm is also the upper limit on the thickness of the anodic oxidation coating film from the standpoints of the production efficiency and ease of production since the production of an alumite film thicker than 500 μm is itself quite difficult. The previously mentioned porosity is also preferably 15 to 40%.

The inventors estimate that the formation of an anodic oxidation coating film having a porosity of 15 to 40% and a thickness of 100 to 500 μm over the entire combustion chamber surface of an internal combustion engine provides a maximum fuel consumption improvement of 5%, for example, for a small supercharged direct injection diesel engine for passenger vehicles at the optimal fuel consumption point corresponding to an engine rotation rate of 2100 rpm and an indicated mean effective pressure of 1.6 MPa. This 5% fuel consumption improvement is a value that demonstrates a clear significant difference for the fuel consumption improvement that rises above experimental measurement error. In addition, it is estimated that, at the same time that the fuel consumption is improved, the exhaust gas temperature is raised by about 15° C. by the heat insulation. In an actual engine, this rise in exhaust gas temperature is effective for shortening the warm-up time of the $NO_x$ reduction catalyst immediately after starting and is a value at which the $NO_x$ purification rate is improved and a reduction in $NO_x$ can be identified.

On the other hand, in a cooling test (quenching test) performed during the evaluation of the thermal properties of anodic oxidation coating films, a test piece is used having the anodic oxidation coating film executed on only one side, and, while continuing to heat the back side (the side on which an anodic oxidation coating film has not been executed) with a prescribed high-temperature jet, cold air at a prescribed temperature is sprayed from the front side of the test piece (the side on which the anodic oxidation coating filth has been executed). This serves to drop the front side temperature of the test piece, and this temperature is measured and a cooling curve is constructed from the temperature of the coating film surface and time in order to evaluate the temperature drop rate. This temperature drop rate is evaluated, for example, through the 40° C. drop time, which is read from the graph and is the time required for the temperature of the coating film surface to drop 40° C.

The quench test is run using test pieces with different porosities (the porosity of the anodic oxidation coating film is determined using the sum of the first void and second void); the 40° C. drop time is measured for each of these test pieces; and, for example, a fitted curve is constructed for the multiple plots defined by the porosity and 40° C. drop time.

By reading the porosity at the intersection of this fitted curve with the value of the 40° C. drop time (for example, 45 msec) that corresponds to the 5% fuel consumption improvement noted above, the inventors determined that this porosity is 15%. The thermal conductivity and heat capacity of the coating film are lower and the fuel consumption improving effect is higher at shorter 40° C. drop times.

On the other hand; anodic oxidation coating film test pieces are fabricated at different porosities and the microVickers hardness of each is measured and a fitted curve is constructed for the multiple plots defined by the porosity and the microVickers hardness. When the base material of the combustion chamber is composed of aluminum, the resulting alumite film desirably is harder than the aluminum base material, and, when this is taken in account by using the microVickers hardness of aluminum as the threshold value, the inventors determined a value of 40% for the porosity when the porosity established by the fitted curve and this threshold value is read off.

Thus the range for the porosity of the anodic oxidation coating film is set to a range of 15 to 40% based on the cooling test, microVickers hardness test, and 5% fuel consumption improvement In addition, when the optimal range for the ratio $\phi/d$—where $\phi$ is an average pore diameter of the first void (average value of pore diameters) and d is an average cell diameter of the hollow cells making up the anodic oxidation coating film—is sought when the porosity is varied, the range corresponding to the previously described 15 to 40% porosity range has been identified by the inventors as 0.3 to 0.6.

The surface of the anodic oxidation coating film is preferably subjected to a sealing treatment with boiling water or steam, or a coating treatment with a thin film that lacks pores, or both treatments. Boiling water to which, for example, sodium silicate has been added as a sealing promoter may be used.

In order to prevent the penetration of fuel and combustion gas into the porous anodic oxidation coating film, for example, a thin film of an inorganic sealant such as sodium silicate coated in a layer thinner than the anodic oxidation coating film is applied as a surface treatment to the anodic oxidation coating film. Viewed from the perspectives both of having the anodic oxidation coating film display the various properties described above and avoiding an excessively large film thickness, this is desirably a thin film, for example, with a thickness of about 10 μm or less, in contrast to the previously described anodic oxidation coating Elm with its film thickness of 100 to 500 μm.

As described above, the anodic oxidation coating film is also preferably an alumite coating film. In addition, the microVickers hardness of this anodic oxidation coating film is preferably in the range from 110 to 400 HV0.025.

In another aspect the invention provides a method of producing an internal combustion engine, as described in the following. Thus, this production method is a method of producing an internal combustion engine by forming an anodic oxidation coating film on all or a portion of a wall facing a combustion chamber in the internal combustion engine, wherein an anode is formed by immersing all or a portion of the wall in an acidic electrolytic bath, a cathode is formed within the acidic electrolytic bath, and then a voltage adjusted to the range of 130 to 200 V for the maximum voltage is applied between the two electrodes, and electrolysis is performed at a heat removal rate adjusted to the range from 1.6 to 2.4 cal/s/cm$^2$, to thereby form an internal combustion engine having, on the surface of all or a portion of the wall, an anodic oxidation coating film that has a structure provided with a bonding region in which each of hollow cells is bonded to the adjacent hollow cells, and a nonbonding region in which three or more adjacent hollow cells are not bonded to each other.

With regard to the conditions for the anodic oxidation treatment for forming the anodic oxidation coating film having the previously described microstructure on all or a portion of the combustion chamber wall of the internal combustion engine, the inventors discovered that electrolysis is favorably carried out by applying a voltage, adjusted to having a maximum voltage in the range from 130 to 200 V, between the anode and cathode in an acidic electrolytic bath in which all or a portion of the wall is immersed, while adjusting the heat removal rate to the range from 1.6 to 2.4 cal/s/cm$^2$. Thus, the execution of electrolysis under these conditions can cause the acid to penetrate into the bottom region (deep region) of the anodic oxidation coating film that is formed and makes possible the production of the first and second voids in the desired size over the entire range reaching to the bottom region- of the anodic oxidation coating film.

This "heat removal rate" is the amount of heat captured by the electrolytic bath per unit time per unit surface are; and adjusting the temperature of the electrolytic bath to the range from −5 to 5° C. provides a beat removal rate in the range from 1.6 to 2.4 cal/s/cm$^2$.

Another embodiment of the method of producing an internal combustion engine according to the invention preferably includes a first step of forming an anode by immersing all or a portion of the wall in an acidic electrolytic bath, forming cathode within the acidic electrolytic bath, and then applying between the two electrodes a voltage adjusted to the range of 130 to 200 V for the maximum, and performing electrolysis at a heat removal rate adjusted to the range from 1.6 to 2.4 cal/s/cm$^2$, to thereby form, on the surface of all or a portion of the wall, an intermediate of the anodic oxidation coating film having a structure that is provided with a bonding region in which each of hollow cells is bonded to the adjacent hollow cells, and a nonbonding region in which three or more adjacent hollow cells are not bonded to each other; a second step of adjusting a porosity determined by a first void present in the hollow cell and a second void that forms the nonbonding region, by widening voids of the intermediate of the anodic oxidation coating film by carrying out a pore widening treatment using acid on all or a portion of the wall that is provided on the surface of the intermediate of the anodic oxidation coating film.

This production method—by further widening the first and second voids through a pore widening treatment of the anodic oxidation coating film provided by electrolysis under the same conditions as in the previously described production method (this anodic oxidation coating film corresponds to the intermediate)—can secure a more reliable generation of porosity in the desired range.

Specifically, by subsequently executing a separate acid-based pore widening treatment (an acid etch treatment in order to enlarge the voids) on an intermediate of the anodic oxidation coating film produced by the first step, the porosity as a whole can be adjusted by widening the first voids by dissolving the interior of the hollow cells and, at the same time, by also widening the second voids by dissolving the circumference of the second voids between the hollow cells. This makes possible the production of an internal combustion engine that is provided, on all or a portion of the combustion chamber wall, with a high thermal conductivity, high beat capacity anodic oxidation coating film that exhibits an excellent pressure relaxing behavior and an excellent thermal stress relaxing behavior.

Also in the production method of the invention, the thickness of the anodic oxidation coating film is preferably adjusted to the range from 100 to 500 μm; the porosity is preferably adjusted to the range from 15 to 40%; and thus the ratio ϕ/d, where ϕ is an average pore diameter of the first void present in the hollow cells and d is an average cell diameter of the hollow cell, is preferably adjusted to the range from 0.3 to 0.6.

In a preferred embodiment of the method according to the invention of producing an internal combustion engine, the production method is additionally provided with, after the formation of the previously described anodic oxidation coating film, a step of performing a sealing treatment with boiling water or steam, or a coating treatment with a thin film that lacks pores, or both treatments.

As with the previously described internal combustion engine of the invention, in order to prevent the penetration of fuel and combustion gases into the anodic oxidation coating film, a step may additionally be present of executing a sealing treatment, or coating the surface with a thin film, or carrying out both. For example, in the case of coating the surface with a thin film, the coating of the surface of the produced anodic oxidation coating film with a thin layer of an inorganic sealant such as sodium silicate can prevent the permeation of fuel and mixed gases into the interior of the anodic oxidation coating film and can, thereby secure the various properties possessed by the anodic oxidation coating film.

This anodic oxidation coating film is also preferably an alumite coating film. In addition, the microVickers hardness of this anodic oxidation coating film is preferably in the range from 110 to 400 HV0.025.

As can be understood from the preceding description, the internal combustion engine and method for its production of the invention—through the formation, on all or a portion of a wall of a combustion chamber of the internal combustion engine, of an anodic oxidation coating film having a structure that has a void (the first void) in the interior of the hollow cells and that also has a void (the second void) at, for example, the triple points among adjacent hollow cells, while chemical bonding occurs in the bonding regions where the hollow cells are in contact with each other—can provide an internal combustion engine provided with a coating film that has a low thermal conductivity and a low heat capacity and thus an excellent heat-insulation behavior, and that also has an excellent ability to relax the expansion pressure and so forth during combustion in the combustion chamber and the repetitive stresses from thermal expansion-shrinkage and that is therefore highly durable.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Embodiments of the internal combustion engine and the method of its production of the invention are described below with reference to the drawings. While the illustrated examples show embodiments in which the anodic oxidation coating film is formed over the entire wall facing the combustion chamber of the internal combustion engine, embodiments may also occur in which the anodic oxidation coating film is formed on only a portion of the wall facing the combustion chamber, e.g., only on the top Surface of the piston or only on the head surface of the valve.

Figure 1:
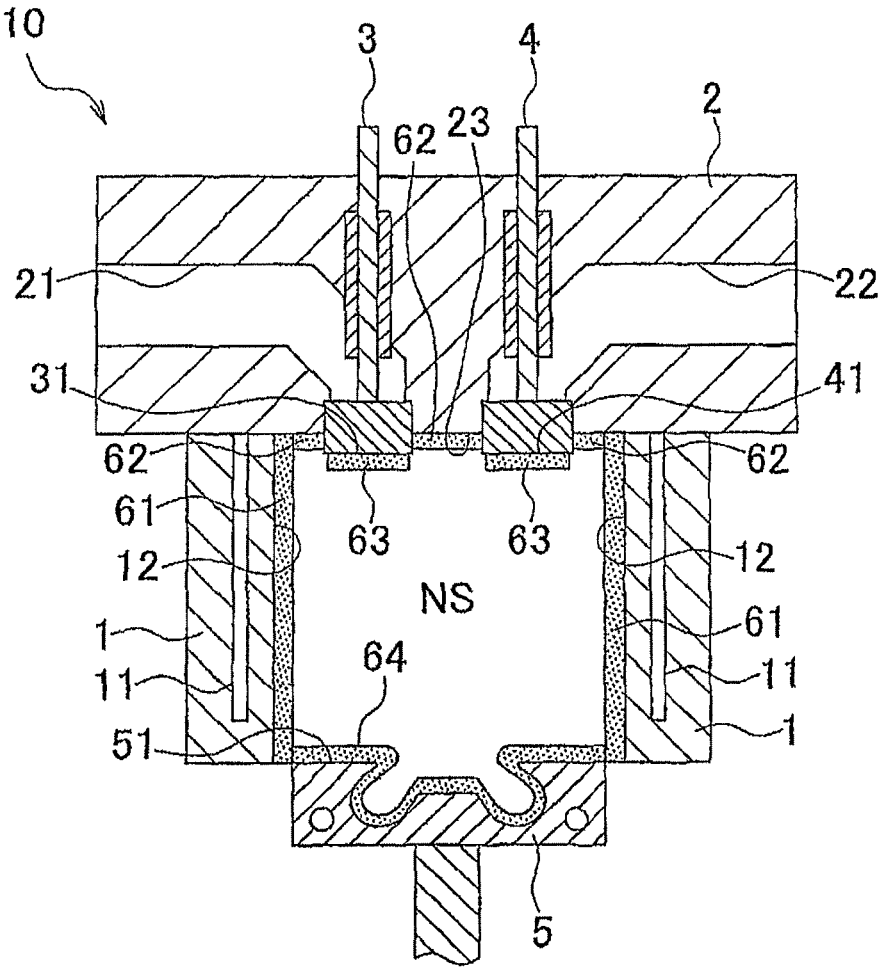
FIG. 1 is a longitudinal sectional view of an internal combustion engine according to an embodiment of the invention.
Figure 2A:
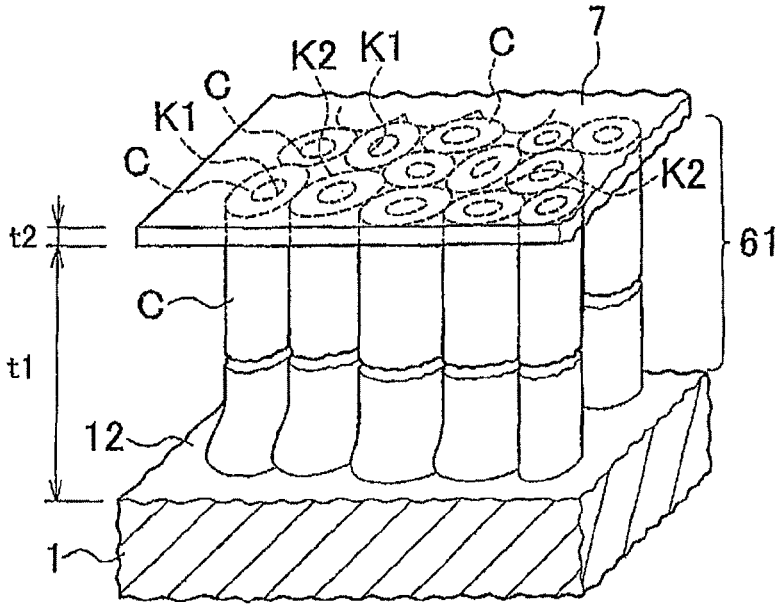
FIG. 2A is a perspective view that describes the microstructure of the anodic oxidation coating film facing the combustion chamber of the internal combustion engine, and also shows the thin film at the surface of the anodic oxidation coating film.
Figure 2B:
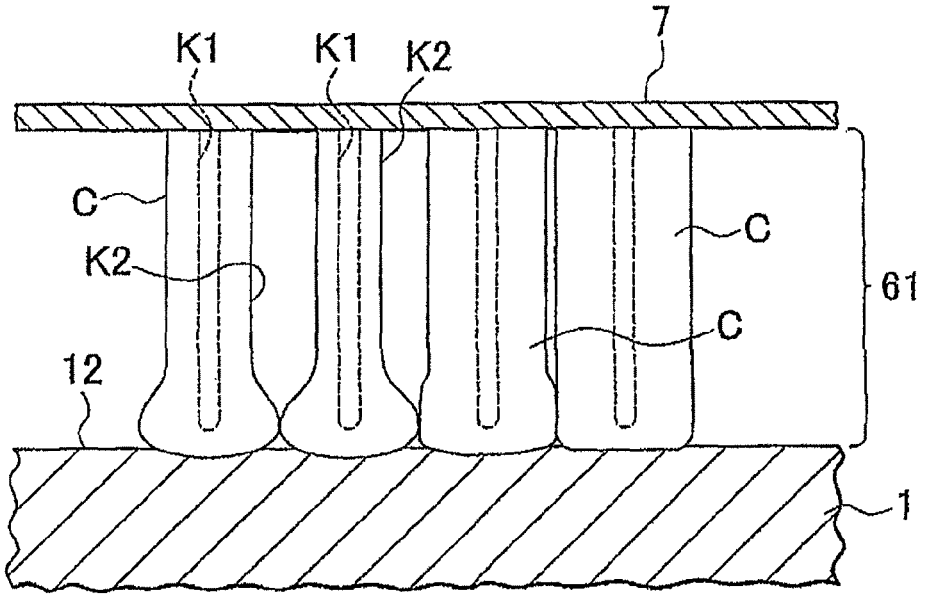
FIG. 2B is a longitudinal sectional view that shows the anodic oxidation coating film and thin film illustrated in FIG. 2A;.
Figure 3A:
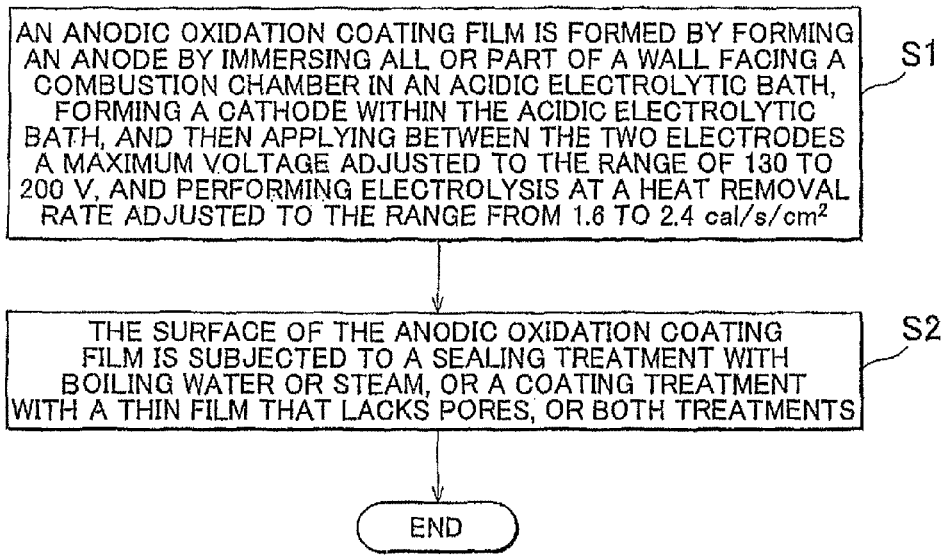
FIG. 3A is a flowchart of the method of producing the internal combustion engine, according to the indicated embodiment.

FIG. 1 is a longitudinal cross-sectional view of an embodiment of the internal combustion engine of the invention; FIGS. 2A and 2B are drawings that show the thin film and the microstructure of an anodic oxidation coating film facing the combustion chamber of an internal combustion engine; and FIG. 3A is a flowchart of an embodiment of the method of producing an internal combustion, engine of the invention.

The illustrated internal combustion engine 10 is directed to a diesel engine and is approximately composed of a cylinder block 1 having a coolant jacket 11 formed therein, a cylinder head 2 disposed above the cylinder block 1, an intake port 21 and an exhaust port 22 defined in the cylinder head 2 and an intake valve 3 and an exhaust valve 4 that are mounted in a freely vertically displaceable manner in the openings where the intake port 21 and exhaust port 22 face the combustion chamber NS, and a piston 5 formed in a manner freely vertically displaceable from the lower opening of the cylinder block 1. The internal combustion engine of the invention may of course be directed to a gasoline engine.

The various constituent members composing this internal combustion engine 10 are made of aluminum or an alloy thereof. In another embodiment, a constituent member may be formed of a material other than aluminum or an alloy thereof and the surface of the constituent member may be aluminized with aluminum or an alloy thereof.

In addition, an anodic oxidation coating film 61, 62, 63, 64 having a prescribed thickness and exhibiting the microstructure shown in FIGS. 2A and 2B is formed within the combustion chamber NS defined by the constituent members of the internal combustion engine 10, at the walls where these face the combustion chamber NS (the cylinder bore surface 12, cylinder head bottom surface 23, piston top surface 51, and valve head surfaces 31, 41).

This microstructure and the method of producing this microstructure will be described using the anodic oxidation coating film 61 formed on the surface of the cylinder bore 12 as an exemplar.

The anodic oxidation coating film 61 formed on the surface of the aluminum or aluminum alloy cylinder bore 12 is alumite, and this anodic oxidation coating film 61 is fanned from a plurality of hollow cells C provided with a first void K1 in the interior and more specifically is a coating film that has a microstructure in which each of the hollow cells C is chemically bonded to adjacent hollow cells C, C and which is provided with a separate second Void K2 in a nonbonding region in which three or more adjacent hollow cells C are not bonded to each other, . . . , e.g., a triple point.

A conventional anodic oxidation coating film does not have a structure, like that of the illustrated anodic oxidation coating film 61, in which the second void K2 is provided among three or more adjacent hollow cells C, . . . ; rather, in a conventional anodic oxidation coating film the interior void-containing hollow cells are chemically bonded to another without a gap therebetween.

In contrast, the illustrated anodic oxidation coating film 61 has a first void K1 in the interior of the hollow cell C and has a separate second void K2 residing in the nonbonding region where the hollow cells C, . . . , are not bonded to one another, and the porosity of the anodic oxidation coating film 61 is determined from this first void K1 and second void K2. The size of the first void K1 and the production and size of the second void K2 can be adjusted, by adjusting as desired the maximum voltage and the acidic electrolyte bath temperature (or the heat removal rate) during the electrolysis that produces the anodic oxidation coating film and by a post-treatment in the form of a pore widening treatment such as an acid etching treatment.

Based on experiments by the inventors, vide infra, this porosity is desirably adjusted to the range from 15 to 40%. The porosity range can be identified by sectioning the anodic oxidation coating film in the middle of its thickness direction; performing ion beam polishing; and carrying out measurement by SEM image analysis. In addition, with regard to the ratio $\phi/d$ where $\phi$ is the average pore diameter of the first void K1 and d is the average cell diameter of the hollow cell C, a ϕ/d in the range from 0.3 to 0.6 corresponds to the aforementioned porosity range of 15 to 40%.

Moreover, the inventors have also ascertained that the thickness t1 of the anodic oxidation coating film 61 is desirably adjusted to the range from 100 to 500 μm.

That is, according to the inventors, when the heat-insulating anodic oxidation coating film has a thickness below 100 μm, the temperature rise of the coating film surface during the combustion cycle is inadequate and the heat-insulating behavior becomes inadequate and an improvement in fuel consumption cannot be achieved. Due to this, the minimum thickness, is set to 100 μm in order to secure this improvement in fuel consumption. On the other hand, the inventors also determined that when the thickness of the anodic oxidation coating film exceeds 500 μm, it takes on a large heat capacity at this point and the swing behavior is impaired because the anodic oxidation coating film itself is then prone to store heat. 500 μm is also the upper limit on the thickness of the anodic oxidation coating film from the standpoints of the production efficiency and ease of production since the production of an alumite film thicker than 500 μm is itself quite difficult The coating film thickness can be measured using, for example, an eddy-current film thickness analyzer and can be determined by taking the average of 10 points.

The anodic oxidation coating film 61, because it has a microstructure that is provided with the separate second voids K2 at, for example, triple points among the hollow cells C that have the first voids K1, has both a low thermal conductivity and a low heat capacity and, in combination with this, also has the ability to relax pressure, e.g., the expansion pressure and injection pressure during combustion in the combustion chamber NS, as well as the ability to relax the repetitive stress from thermal expansion-shrinkage.

In addition, the adjustment of its thickness into the 100 to 500 μm range as described above secures its ease of production and provides a film having a heat-insulating behavior as well as a swing behavior, i.e., the temperature of the anodic oxidation coating film tracks the gas temperature in the combustion chamber NS.

Moreover, the inventors estimate that, through the adjustment of the range of the porosity determined by the first void K1 and the second void K2 into the 15 to 40% range, a maximum fuel consumption improvement of 5% is obtained, for example, for a small. supercharged direct injection diesel engine for passenger vehicles at the optimal fuel consumption point corresponding to an engine rotation of 2100 rpm and an indicated mean effective pressure of 1.6 MPa. In addition, at the same time that the fuel consumption is improved, the exhaust gas temperature is raised by about 15° C. by the heat insulation, which ties into shortening the warm-up time of the $NO_x$ reduction catalyst immediately after starting and improves the $NO_x$ purification rate and can realize a reduction in $NO_x$.

In order to prevent the penetration of fuel and combustion gas into the anodic oxidation coating film 61 prodded with the first and second voids K1, K2, a thin film 7 may be formed at the surface of the anodic oxidation coating film 61 by the application of an inorganic sealant such as sodium silicate in a layer thinner than that of the anodic oxidation coating film 61.

Viewed from the perspectives both of having the anodic oxidation coating film display the various properties described above and avoiding an excessively large film thickness, the thickness t2 of this thin film 7 is desirably adjusted to, for example, a thickness of about 10 μm or less, in contrast to the film thickness t1 of 100 to 500 μm for the anodic oxidation coating film 61.

Figure 4:
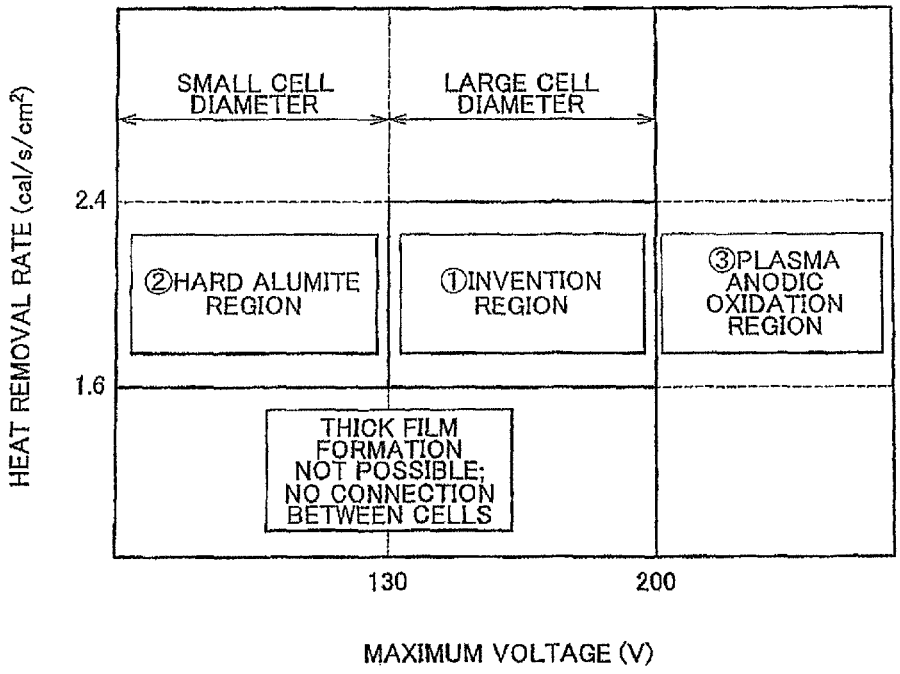
FIG. 4 is a matrix diagram that shows the maximum voltage range and heat removal rate range in the first step of the method of producing an internal combustion engine, and that also describes the nonconforming ranges.

The method of producing the illustrated internal combustion engine 10 is summarized in the following with reference to the flow chart FIG. 3A and FIG. 4. FIG. 4 is a matrix diagram that shows the maximum voltage range and heat removal rate range in the first step of the method of producing the internal combustion engine, and that also describes the nonconforming ranges.

An anodic oxidation coating film is first formed (step S1) by forming an anode by immersing the wall of the particular member that faces the combustion chamber NS in an acidic electrolytic bath (not shown) of, e.g., sulfuric acid, forming a cathode within the acidic electrolytic bath, and then applying between the two electrodes a voltage adjusted to the range of 130 to 200 V for the maximum voltage, and performing electrolysis at a heat removal rate adjusted to the range from 1.6 to 2.4 call/s/$cm^2$. These numerical value ranges are discussed below. This "heat removal rate" is the amount of heat captured by the electrolytic bath Per unit time per unit surface area.

The execution of film formation under the aforementioned conditions in this anodic oxidation treatment step serves to promote hollow cell growth, to widen the first and second voids and thereby adjust the porosity into the 15 to 40% range, and to enable the production of a coating film with a film thickness in the 100 to 500 μm range.

Once the anodic oxidation coating film with the desired porosity has been produced, the surface of the anodic oxidation coating film is subjected to a sealing treatment with boiling water or steam, or a coating treatment with a thin film that lacks pores, or both treatments, in order to thereby produce an internal combustion engine that has, formed on a combustion chamber, wall, an anodic oxidation coating film that does not take fuel or mixed gas into the pores of the anodic oxidation coating film (step S2).

Figure 3B:
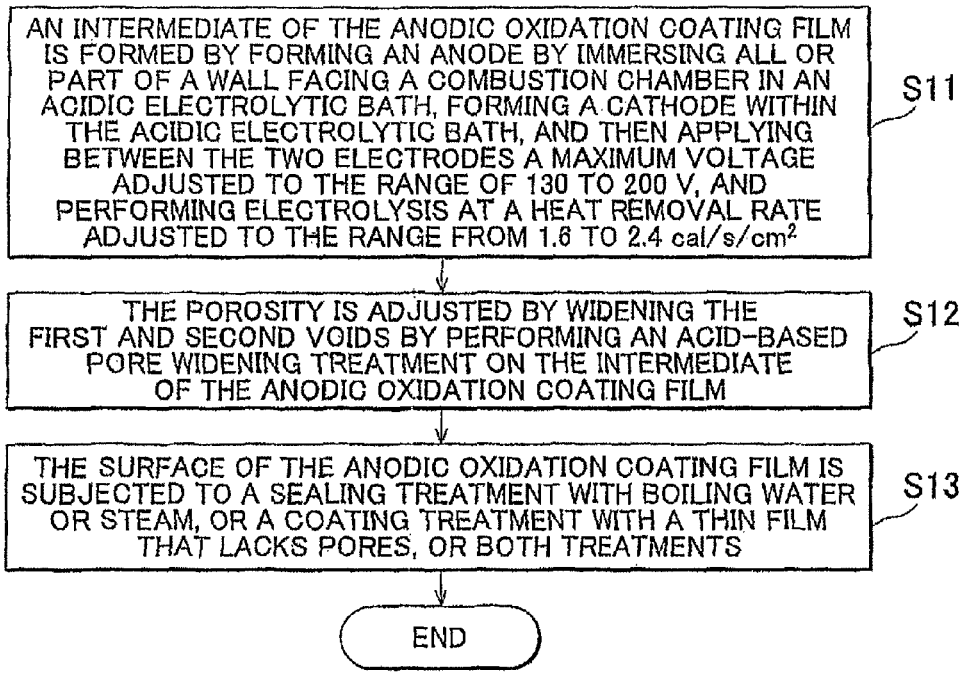
FIG. 3B is a flowchart of a production method according to another embodiment.

FIG. 3B is a flowchart that shows another embodiment of the production method. In this production method, an intermediate of the anodic oxidation coating film is formed by the same method as in step S1 in FIG. 3A (first step, anodic oxidation treatment step, step S11), and this intermediate is then subjected to a pore widening treatment using an acid such as phosphoric acid (acid etching treatment) to widen the first and second voids and carry out adjustment into the 15 to 40% porosity range (second step, pore widening treatment step, step S12). In other words, in the production method of this embodiment, an even more reliable adjustment into the 15 to 40% porosity range is performed by having this second step.

Once an anodic oxidation coating film having the desired thickness has been produced by carrying out this adjustment to generate the desired porosity, the internal combustion engine is produced by subjecting the surface of the anodic oxidation coating film, as in the production method in FIG. 3A, to a sealing treatment or a coating treatment or both treatments (step S13).

FIG. 4 shows, in the form of a matrix constructed by the inventors, the condition range for the first step of the invention (the invention region in the figure) as set by the heat removal rate range and the range of the maximum voltage applied between the electrodes in the acidic electrolytic bath, and also shows the regions outside this range.

By adjusting the maximum voltage into the 130 to 200 V range and adjusting the heat removal rate into the 1.6 to 2.4 cal/s/$cm^2$ range, an anodic oxidation coating film can be formed in the desired thickness in this anodic oxidation treatment step and first and second voids having the desired size can be formed in this stage (voids of a certain size can be preliminarily produced in this stage as a pretreatment for the formation of voids with the desired porosity by the pore widening treatment step implemented as a post-treatment).

According to the inventors, the temperature of the electrolytic bath is desirably adjusted to the range from −5 to 5° C. for a heat removal rate in the range from 1.6 to 2.4 cal/s/cm$^2$. The heat removal rate can be adjusted using both the temperature of the electrolytic bath and the stirring rate for the electrolytic bath.

In the region which is the same heat removal rate region as the invention region but the maximum voltage is less than the invention region, i.e., the maximum voltage is less than 100 V, the hollow cell size ends up being small and a hard alumite region occurs in which the second void is not formed between cells.

On the other hand, in the region which is the same heat removal rate region as the invention region but the maximum voltage is higher than the invention region, i.e., the maximum voltage exceeds 200 V, a plasma anodic oxidation region occurs in which hollow cells are not formed.

In addition, in the heat removal rate region below the invention region, the anodic oxidation coating film cannot form the desired film thickness of at least 100 μm, and it has been determined that a coating film is formed in which there is no connection by chemical bonding between the cells.

Figures 5A, 5B:
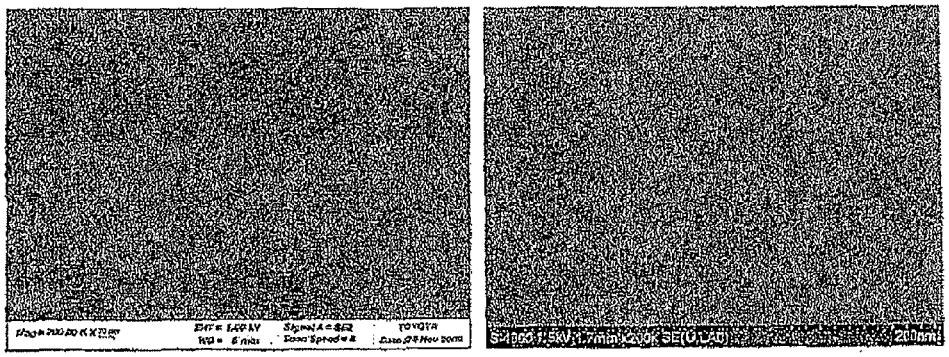
FIG. 5A is a photograph taken by scanning electron microscopy (SEM) of a cross section of the coating film surface after the anodic oxidation treatment (first step); for an anodic oxidation coating film according to a comparative example (hard alumite region)
FIG. 5B is an SEM photograph of a cross section of the bottom side of the coating film after the anodic oxidation treatment, for an anodic oxidation coating film according to the comparative example.
Figures 5C, 5D:
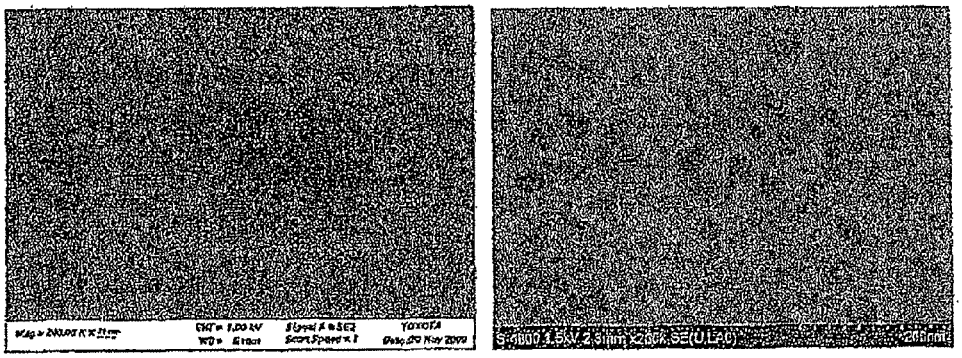
FIG. 5C is an SEM photograph of a cross section of the coating film surface after the anodic oxidation treatment, for an anodic oxidation coating film according to an example (invention region)
FIG. 5D is an SEM photograph of a cross section of the bottom side of the coating film after the anodic oxidation treatment, for an anodic oxidation coating film according to the example.
Figures 6A, 6B:
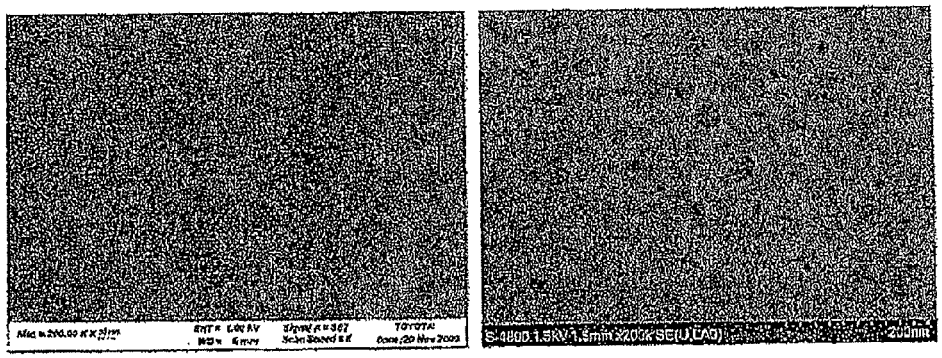
FIG. 6A is an SEM photograph of the cross section of the coating film surface after the pore widening treatment (second step), for an anodic oxidation coating film according to a comparative example (hard alumite region)
FIG. 6B is an SEM photograph of the cross section of the bottom side of the coating film after the pore widening treatment, for an anodic oxidation coating film according to the comparative example.
Figures 6C, 6D:
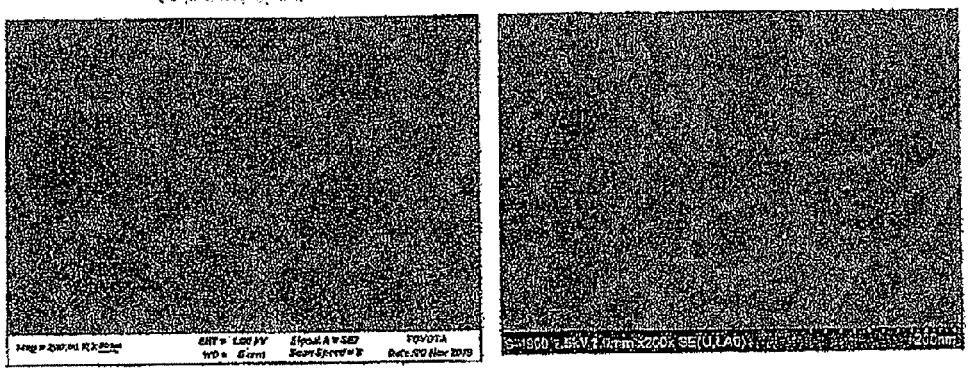
FIG. 6C is an SEM photograph of the cross section of the coating film surface after the pore widening treatment, for an anodic oxidation coating film according to an example (invention region)
FIG. 6D is an SEM photograph of the cross section of the bottom side of the coating film after the pore widening treatment, for an anodic oxidation coating film according to the example.
Figure 7:
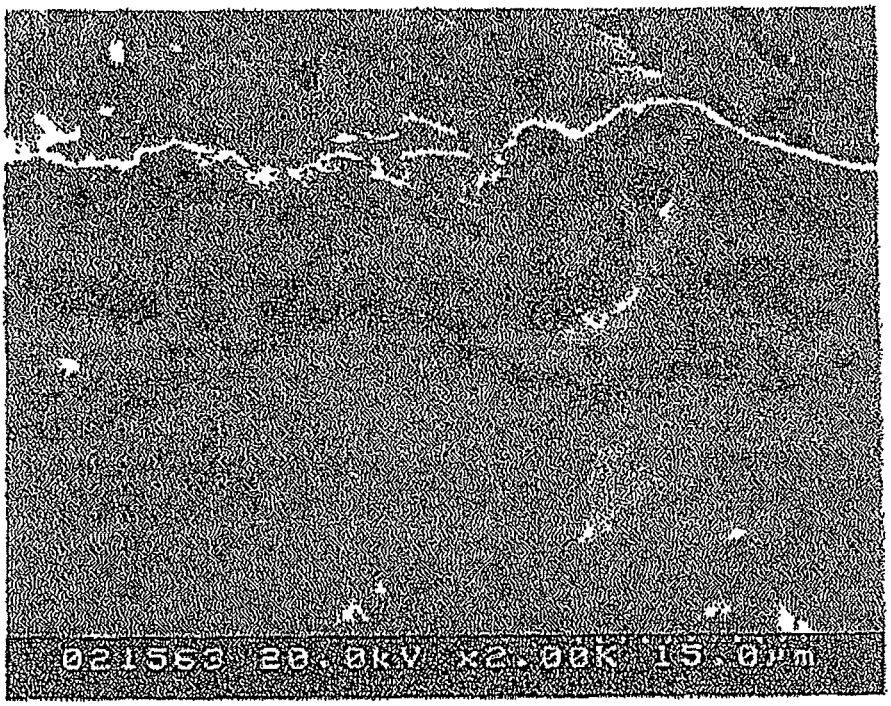
FIG. 7 is an SEM photograph of the cross section of an anodic oxidation coating film according to a comparative example (plasma anodic oxidation region)

Treatment conditions are shown below in Tables 1 and 2 for an anodic oxidation coating film formed in the invention region shown in FIG. 4 (example), an anodic oxidation coating film formed in the hard alumite region (hard region) (comparative example), and an anodic oxidation coating film formed in the plasma anodic oxidation region (plasma region) (comparative example). SEM photographs of the example and comparative examples are shown in. FIGS. 5A to 5D, FIGS. 6A to 6D, and FIG. 7. More specifically, FIG. 5C contains an SEM photograph of the cross section of the coating film surface (combustion chamber side) after the anodic oxidation treatment of the example; FIG. 5D contains an SEM photograph of the cross section of the bottom side of the coating film (side at the surface of the member on which the coating film is formed) after the anodic oxidation treatment of the example; FIG. 5A contains an SEM photograph of the cross section of the coating film surface after the anodic oxidation treatment according to a comparative example (hard alumite region); and FIG. 5B contains an SEM photograph of the cross section of the bottom side of the coating filth after the anodic oxidation treatment according to the comparative example (hard alumite region). FIG. 6C contains an SEM photograph of the cross section of the coating film surface after the pore widening treatment of the example; FIG. 6D contains an SEM photograph of the cross section of the bottom side of the coating film after the pore widening treatment of the example; FIG. 6A contains an SEM photograph of the cross section of the coating film surface, after the pore widening treatment in a comparative example (hard alumite region); and FIG. 6B contains an SEM photograph of the cross section of the bottom side of the coating film after the pore widening treatment in the comparative example (hard alumite region). FIG. 7 contains an SEM photograph of the cross section of the anodic oxidation coating film of a comparative example (plasma anodic oxidation region).

TABLE 1

| | conditions in the anodic oxidation treatment step | | | | | | | |
|---|---|---|---|---|---|---|---|---|
| | electrolytic bath | heat removal rate (cal/s/cm$^2$) | Bath temperature (° C.) | Maximum voltage (V) | current density (mA/cm$^2$) | Treatment time (min) | avg. film thickness (μm) | porosity (%) |
| (1) invention region | 20% sulfuric acid | 1.9 | 0 | 120 | 90 | 60 | 155 | 20.1 |
| (2) hard region | | 2.6 | | 50 | 10 | 120 | 141 | 3.5 |
| (3) plasma region | | 1.9 | | 250 | 50 | 60 | 13 | — |

TABLE 2

| | conditions in the pore widening treatment step | | | | |
|---|---|---|---|---|---|
| | acid | Temperature (° C.) | treatment time (min) | average film thickness (μm) | porosity (%) |
| (1) invention region | 5% phosphoric acid | 25 | 20 | 143 | 33.8 |
| (2) hard region | | | | 131 | 7.0 |
| (3) plasma region | — | — | — | — | — |

In the case of the coating film of the example, it can be confirmed from FIGS. 5 and 6 that the anodic oxidation treatment has produced hollow cells of a certain size provided with voids of a certain size, at both the surface of the coating film and at its bottom side; that a portion of the cells has been dissolved by the pore widening treatment to yield large voids both for the voids within the cells and the voids at, for example, triple points among cells; and that the cells have large outer diameters and are bonded (chemical bonding) to each other.

In contrast, hi the case of the coating film of the comparative example in which film formation was carried, out in the hard alumite region, only very small voids are produced in the anodic oxidation treatment stage; the pore widening treatment results in just a minor widening of the voids in the cells, resulting in an unsatisfactory size; and voids are not produced at, for example, the triple points among cells.

In addition, in the case of the coating film of the comparative example in which film formation was carried out in the plasma anodic oxidation region, hollow cell production itself could not be confirmed, as shown in FIG. 7.

Figure 8A:
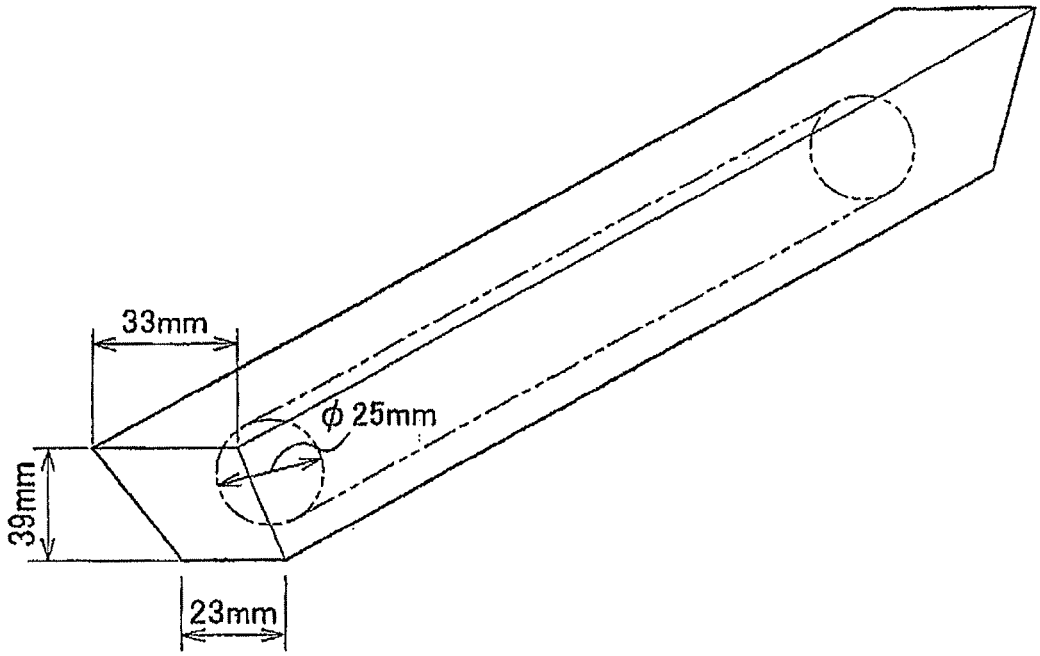
FIG. 8A is a perspective view that shows a casting that is the source for test pieces used hi the experiments.
Figure 8B:
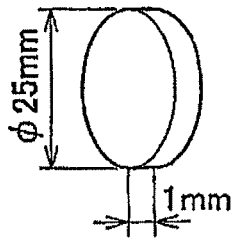
FIG. 8B is a perspective view that shows a test piece cut from the casting.

Experiments that identify the porosity range and the results of these experiments are described in the following. The inventors carried out cooling tests, microVickers hardness testing, and experiments to identify the optimal, porosity range for the anodic oxidation coating film from the percentage improvement in fuel consumption. First, with regard to the execution of the cooling test, the casting shown in FIG. 8A was fabricated by casting the aluminum alloy with the composition shown in Table 3 using a casting die (not shown) (casting was done at 700° C. by melting in air using a 30 kg melting furnace), and test pieces were fabricated by cutting this in a thickness of 1 mm as shown in FIG. 8B. The anodic oxidation coating film was formed on only a single side of each test piece, and the cooling test was carried out using the resulting piece.

TABLE 3

| component | Cu | Si | Mg | Zn | Fe | Mn | Ni | Ti | Al |
|---|---|---|---|---|---|---|---|---|---|
| content (mass %) | 0.99 | 12.3 | 0.98 | 0.11 | 0.29 | <0.01 | 1.27 | <0.01 | balance |

Figure 9A:
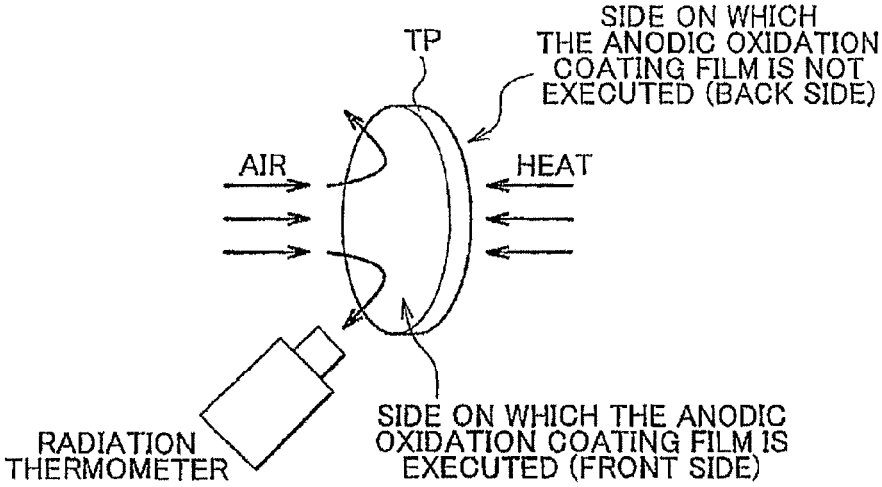
FIG. 9A is a schematic diagram that illustrates the scheme of the cooling test.
Figure 9B:
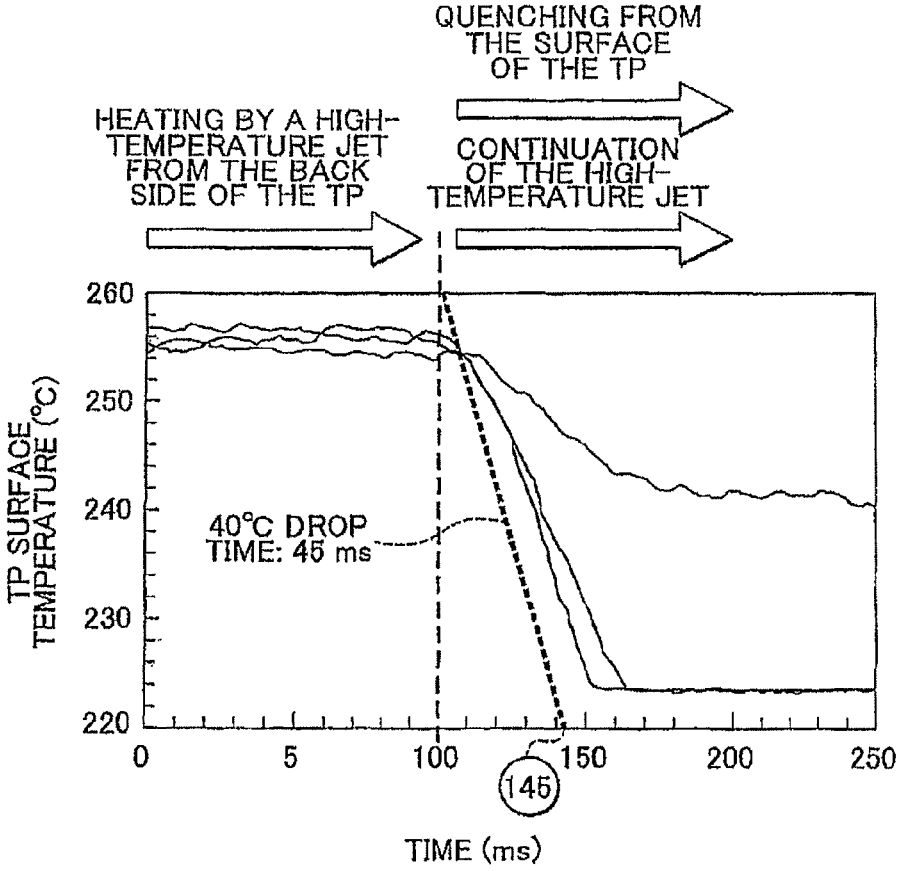
FIG. 9B shows a cooling curve based on the results of the cooling test and the 40° C. drop time derived from this cooling curve.

The cooling test is summarized in the following. As shown in FIG. 9A, a test piece TP is used in which the anodic oxidation coating film has been formed on only a single side; the back side (side on which the anodic oxidation coating film has not been executed) is heated with a 750° C. high-temperature jet (indicated by Heat in the figure) and the test piece TP as a whole is stabilized at about 250° C.; and cooling is begun by moving a nozzle, which is already ejecting a room-temperature jet at a prescribed flow rate, to the front side of the test piece TP (the side on which the anodic oxidation coating film has been executed) using a linear motor (cooling air at 25° C. (indicated by Air in the figure) is supplied while the high-temperature jet on the back side is continued). The temperature of the surface of the anodic oxidation coating film on the test piece TP is measured using an externally disposed radiation thermometer in order to measure the temperature drop during this cooling interval and the cooling curve shown in FIG. 9B is constructed. This cooling test is a test method that simulates the intake stroke at the interior wall of the combustion chamber and evaluates the cooling rate for the surface of a heat-insulating coating film that has been heated. A low thermal conductivity, low heat capacity heat-insulating film will exhibit a rapid quench rate.

The time required fox a 40° C. drop is read from the thusly constructed cooling curve to give the 40° C. drop time, and the thermal properties of the coating film are evaluated through this 40° C. drop time.

In the experiment under consideration, front side cooling is begun after stabilization at about 250° C. for 100 ms, as shown in FIG. 9B, and 45 ms is measured for the 40° C. drop time.

The inventors used a 5% fuel consumption improvement as a target value to be achieved during the experiments by the performance of the anodic oxidation coating film constituting the combustion chamber of the internal combustion engine of the invention. A 5% fuel consumption improvement is a value that can clearly validate a fuel consumption improvement without being obscured by measurement error and that, through the increase in the exhaust gas temperature, can shorten the warm-up time for the $NO_x$ reduction catalyst and can realize a reduction in $NO_x$. The inventors sought to identify the porosity range for achieving this target value. The graph shown in FIG. 10 is a correlation between the fuel consumption improvement determined by the inventors and the 40° C. drop time in the cooling test.

Figure 10:
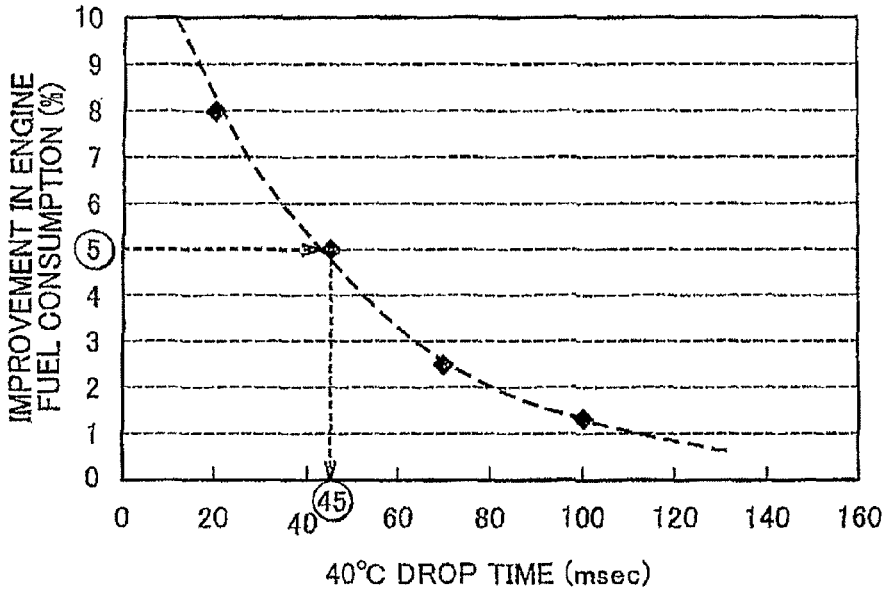
FIG. 10 is a graph of the correlation between the percentage fuel consumption improvement and the 40° C. drop time in the cooling test.

A fitted curve (quadratic curve) is constructed as shown in FIG. 10 based on results for the 40° C. drop time corresponding to fuel consumption improvements of 8%, 5%, 2.5%, and 1.3%. The 40° C. drop time corresponding to a 5% fuel consumption improvement agrees with the 45 ms identified in FIG. 9B.

In order to construct a correlation graph for the relationship between the cooling test and porosity and for the relationship between the microVickers hardness and porosity, test pieces were fabricated under the anodic oxidation treatment step conditions (and pore widening treatment step conditions for the examples) shown in Table 4 below using nine different porosities for the anodic oxidation coating filth, in accordance with Comparative Examples 1 to 5 and Examples 1 to 4. The results of measurement of the anodic oxidation coating film thickness, porosity, microVickers hardness, and 40° C. drop time are shown in Table 5 for each test piece.

In the microVickers hardness testing, the microVickers hardness was measured in the middle of the cross section of the anodic oxidation coating film, and the average value at five measurement points on each test piece at a measurement load of 0.025 kg was used as the microVickers hardness.

TABLE 4

| | conditions in the anodic oxidation treatment step | | | | | |
|---|---|---|---|---|---|---|
| TP | heat removal rate (cal/s/cm$^2$) | bath temperature (° C.) | maximum voltage (V) | current density (mA/cm$^2$) | treatment time (hr) | pore widening treatment time (min) |
| Comp. Ex. 1 | 2.6 | 0 | 50 | 10 | 2 | — |
| Comp. Ex. 2 | 1.0 | 10 | 50 | 30 | 1 | — |
| Comp. Ex. 3 | 1.6 | 5 | 100 | 30 | 2 | — |
| Example 1 | 1.6 | 5 | 135 | 30 | 2 | — |
| Example 2 | 2.4 | −3 | 160 | 90 | 1 | — |
| Example 3 | 2.0 | 0 | 150 | 90 | 1 | — |
| Example 4 | 2.0 | 0 | 150 | 90 | 1 | 20 |
| Comp. Ex. 4 | 2.0 | 0 | 140 | 90 | 1 | 40 |
| Comp. Ex. 5 | 2.0 | 0 | 150 | 90 | 1 | 60 |
| base material | — | — | — | — | — | — |

TABLE 5

| TP | coating film thickness (μm) | porosity (%) | microVickers hardness (HV0.025) | 40° C. drop time (msec) | avg. cell diameter: d (nm) | avg. pore diameter: ϕ (nm) | ϕ/d |
|---|---|---|---|---|---|---|---|
| | measured values for the anodic oxidation coating films | | | | | | |
| Comp. Ex. 1 | 100 | 3.0 | 444 | 250 | 80 | 10 | 0.13 |
| Comp. Ex. 2 | 60 | 9.2 | 440 | 187.3 | 90 | 20 | 0.22 |
| Comp. Ex. 3 | 116 | 13.4 | 431 | 50.4 | 90 | 30 | 0.33 |
| Example 1 | 124 | 25.6 | 350 | 44.5 | 110 | 50 | 0.45 |
| Example 2 | 156 | 31.5 | 294 | 40.3 | 80 | 40 | 0.50 |
| Example 3 | 155 | 20.1 | 379 | 44.0 | 100 | 40 | 0.40 |
| Example 4 | 143 | 33.8 | 250 | 42.7 | 150 | 90 | 0.60 |
| Comp. Ex. 4 | 136 | 41.3 | 91 | 41.9 | 140 | 90 | 0.64 |
| Comp. Ex. 5 | 138 | 43.0 | 101 | 41.7 | 160 | 90 | 0.56 |
| base material | — | — | 130 | 440 | — | — | — |

Figure 11:
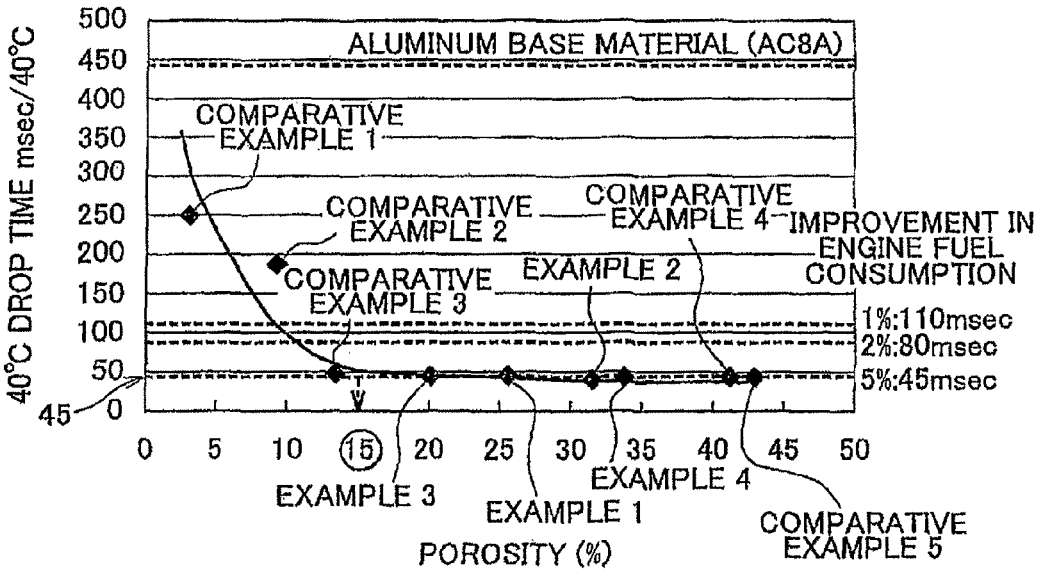
FIG. 11 is a graph of the correlation between The 40° C. drop time and the porosity.

To determine the relationship between the cooling test and porosity, experiments were nm using the method shown in FIG. 9A on the test pieces of Comparative Examples 1 to 5 and Examples 1 to 4 and the results were plotted as shown in FIG. 11 and the fitted curve therefor was determined. FIG. 11 shows the fitted curve, the 40° C. drop times corresponding to fuel consumption improvements of 1%, 2%, and 5% (110 msec for 1%, 80 msec for 2%, and 45 msec for 5%), and the 40° C. drop time threshold value of the aluminum base material (440 msec).

Based on FIG. 11 and Table 5, the porosity at the intersection of 45 msec, which is the 40° C. drop time threshold value corresponding to a 5% fuel consumption improvement, and the fitted curve for,the individual test pieces is 15%, and this is then set as the lower Emit on the numerical limitation range for the porosity of the anodic oxidation coating film. The 40° C. drop time exceeds 45 msec for the test pieces in Comparative Examples 1 to 3 as shown in Table 5, confirming the difficulty of achieving a 5% fuel consumption improvement with these anodic oxidation coating films.

Figure 12:
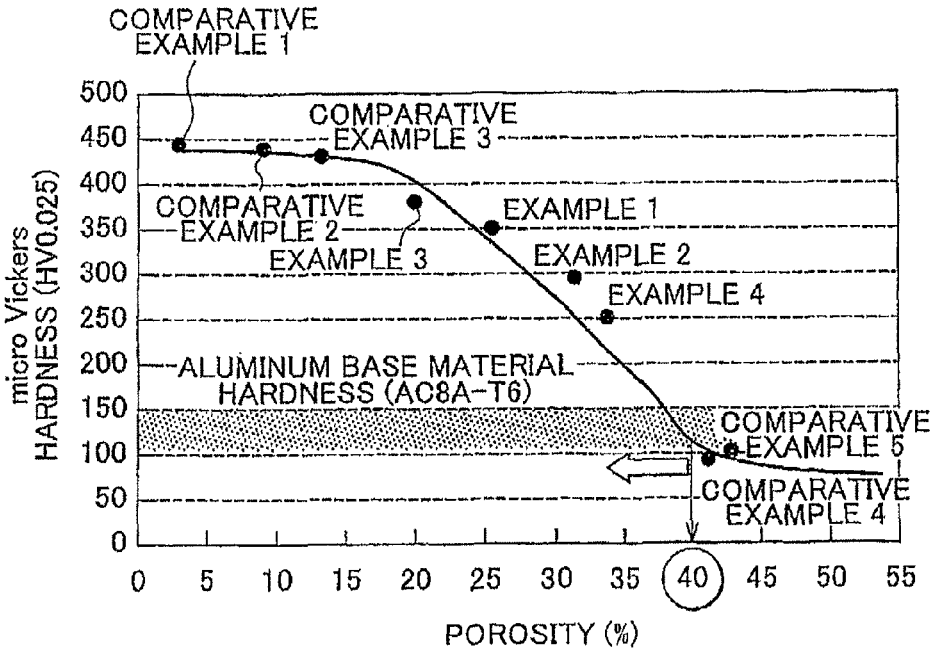
FIG. 12 is a graph of the correlation between the microVickers hardness and the porosity.

The microVickers hardness and porosity of the test pieces are plotted in FIG. 12, which also gives the corresponding fitted curve. The range of 110 to 150 HV0.025, which is the threshold range for the hardness of the aluminum base material, is shown in gray.

Based on FIG. 12 and Table 5, the porosity at the intersection between the fitted curve and the 110 microVickers hardness of the aluminum base material is 40%, and this is set as the upper limit of the numerical limitation range for the porosity of the anodic oxidation coating film. As read out from FIG. 12, the microVickers hardness of the anodic oxidation doating film may be brought to 110 to 400 HV0.025 to provide a porosity for the anodic oxidation coating film of 15% to 40%.

Based on the preceding results; the optimal range for the porosity of the alumite (anodic oxidation coating film) formed on the combustion chamber wall of the internal combustion engine can be set to the range of 15 to 40%.

Figure 13:
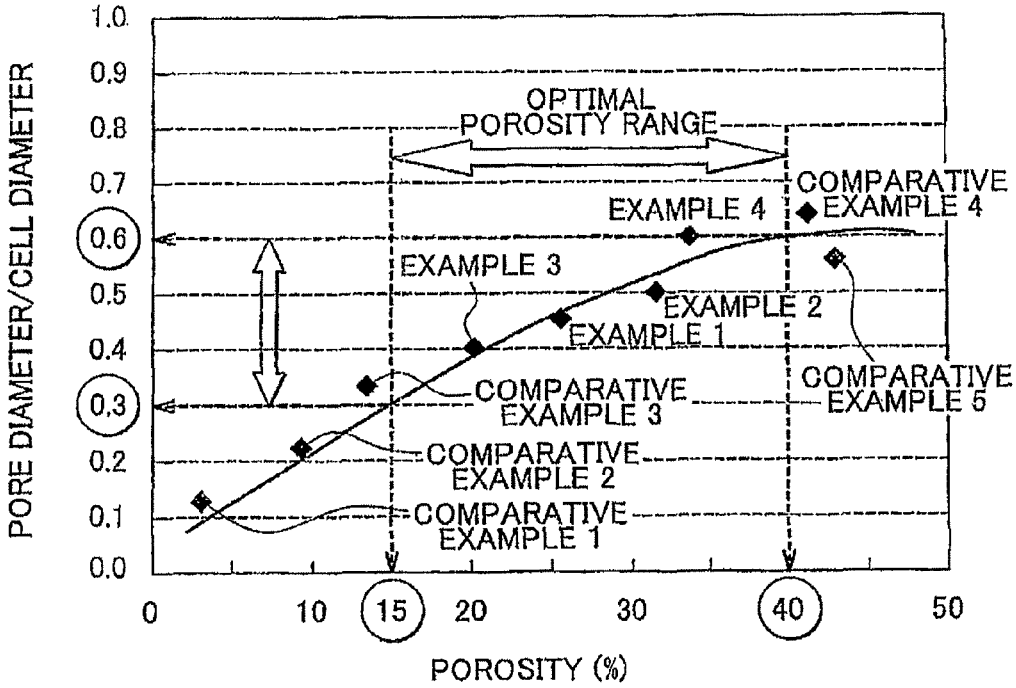
FIG. 13 is a graph that describes ϕ/d versus the optimal porosity range where ϕ is the average pore diameter of the first void and d is the average cell diameter of the hollow cells.

A graph correlating the ϕ/d in Table 5 with the porosity is shown in FIG. 13. It may be understood from this figure that the ϕ/d range that corresponds to the optimal porosity range of 15 to 40% is 0.3 to 0.6. When ϕ/d is in the 0.3 to 0.6 range while the porosity is less than 15% or greater than 40%, as in Comparative Examples 3 and 5, it cannot be said that these are optimal examples of the anodic oxidation coating film to be formed on the combustion chamber in the internal combustion engine of the invention, and as a consequence the optimal range for ϕ/d is set as noted above with the previously described optimal range for the porosity as a prerequisite.

Figure 14A:
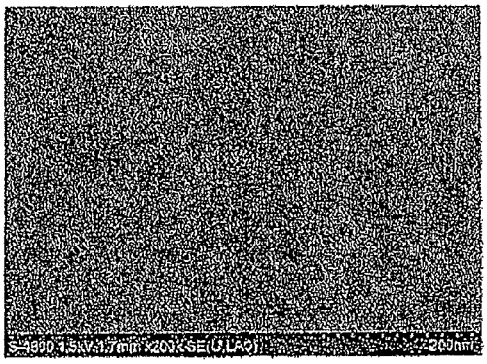
FIG. 14A is an SEM photograph of the cross section of the Comparative Example 1 alumite used in the experiments.
Figure 14B:
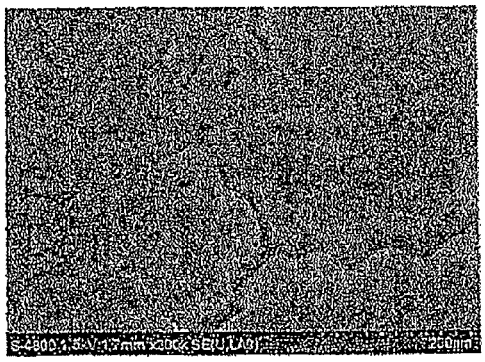
FIG. 14B is an SEM photograph of the cross section of the alumite of Comparative Example 2.
Figure 14C:
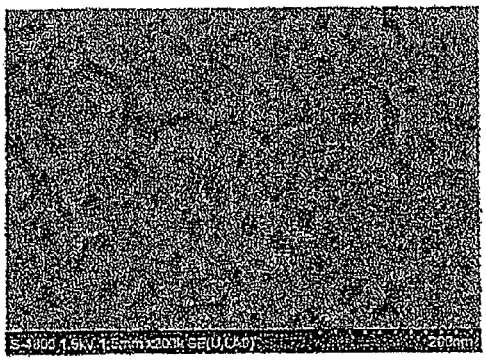
FIG. 14C is an SEM photograph of the cross section of the alumite of Comparative Example 3.
Figure 15A:
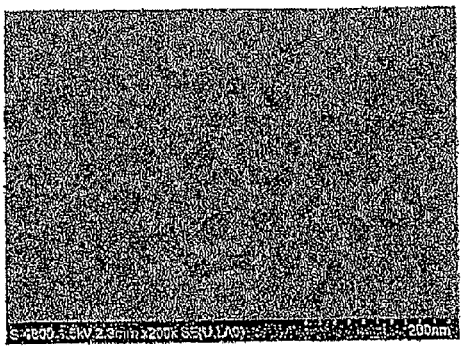
FIG. 15A is an SEM photograph of the cross section of the Example 1 alumite used in the experiments.
Figure 15B:
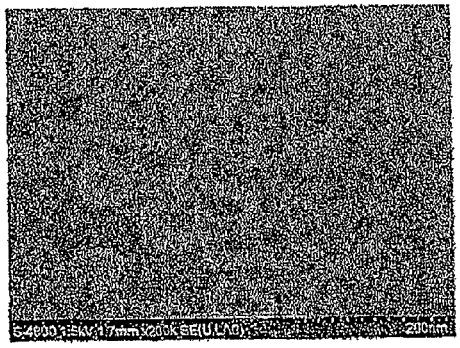
FIG. 15B is an SEM photograph of the cross section of the alumite of Example 2.
Figure 15C:
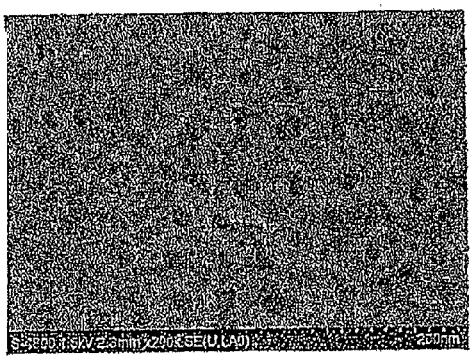
FIG. 15C is an SEM photograph of the cross section of the alumite of Example 3.
Figure 15D:
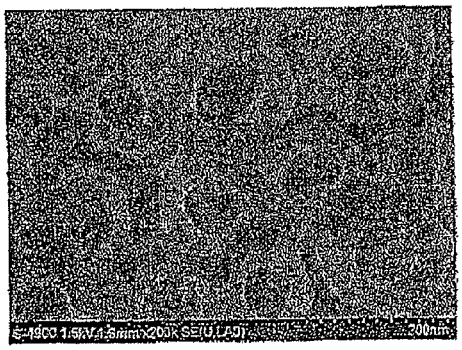
FIG. 15D is an SEM photograph of the cross section of the alumite of Example 4.
Figure 16A:
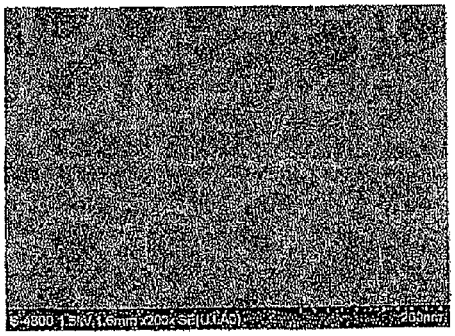
FIG. 16A is an SEM photograph of the cross section of the Comparative Example 4 alumite used in the experiments.
Figure 16B:
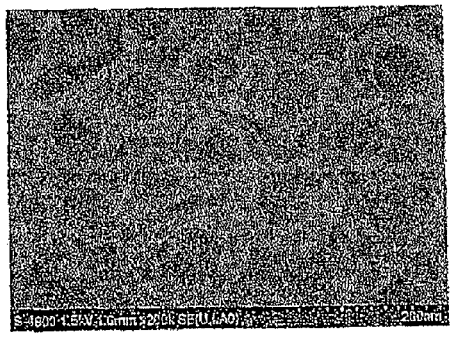
FIG. 16B is an SEM photograph of the cross section of the alumite of Comparative Example 5.

SEM photographs of the cross sections in the examples and comparative examples are shown in FIGS. 14A to 14C, 15A to 15D, 16A and 16B. More specifically, FIG. 14A is an SEM photograph of the cross section of the alumite of Comparative Example 1; FIG. 14B is an SEM photograph of the cross section of the alumite of Comparative Example 2; FIG. 14C is an SEM photograph of the cross section of the alumite of Comparative Example 3; FIG. 15A is an SEM photograph of the cross section of the alumite of Example 1; FIG. 15B is an SEM photograph of the cross section of the alumite of Example 2; FIG. 15C is an SEM photograph of the cross section of the alumite Example 3; FIG. 15D is an SEM photograph of the cross section of the alumite of Example 4; FIG. 16A is an SEM photograph of the cross section of the alumite of Comparative Example 4; and FIG. 16B is an SEM photograph of the cross section of the alumite of Comparative Example 5.

Based on the individual figures, the comparative examples do not have adequately large pores, and the following can also be confirmed from these figures: adequate gaps are not present between the cells (Comparative Examples 1, 2, and 3), and the voids are excessively large and/or the cells are not adequately chemically bonded to each other (Comparative Examples 4 and 5). In contrast, the following can be confirmed for the examples: the cells are provided in their interior with voids of a certain size; voids of a certain size are also present at the triple points among cells (nonbonding regions); and, because these voids are not excessively large, a bonding region is provided in which the cells are chemically bonded to each other at either points or sides.

Experiments for determining the relationship between the maximum voltage and the surface temperature drop rate will now be described, as will the results of these experiments. The inventors measured the surface temperature drop rate (40° C. drop time) as a function of the maximum voltage on test pieces prepared using different maximum voltages in the anodic oxidation treatment, as shown in Table 6. These measurement results were plotted and a fitted curve was constructed for the plotted values, as shown in FIG. 17.

TABLE 6

| | conditions in the anodic oxidation treatment step | | | | | | |
|---|---|---|---|---|---|---|---|
| electrolytic bath | heat removal rate (cal/s/cm$^2$) | bath temperature (° C.) | current density (mA/cm$^2$) | treatment time (min) | maximum voltage (V) | avg. coating film thickness (μm) | surface temperature drop rate (ms/40° C.) |
| 10% sulfuric acid | 1.9 | 0 | 150 | 30 | 42 | 95 | 64.1 |
| | | | 150 | 30 | 50 | 106 | 62.4 |
| | | | 90 | 60 | 110 | 199 | 49.5 |
| | | | 90 | 60 | 116 | 199 | 50.1 |
| | | | 90 | 45 | 103 | 159 | 55.5 |
| | | | 90 | 100 | 137 | 252 | 41.1 |
| 20% sulfuric acid | | | 90 | 60 | 128 | 186 | 45.0 |
| | | | 90 | 60 | 133 | 170 | 44.0 |

Figure 17:
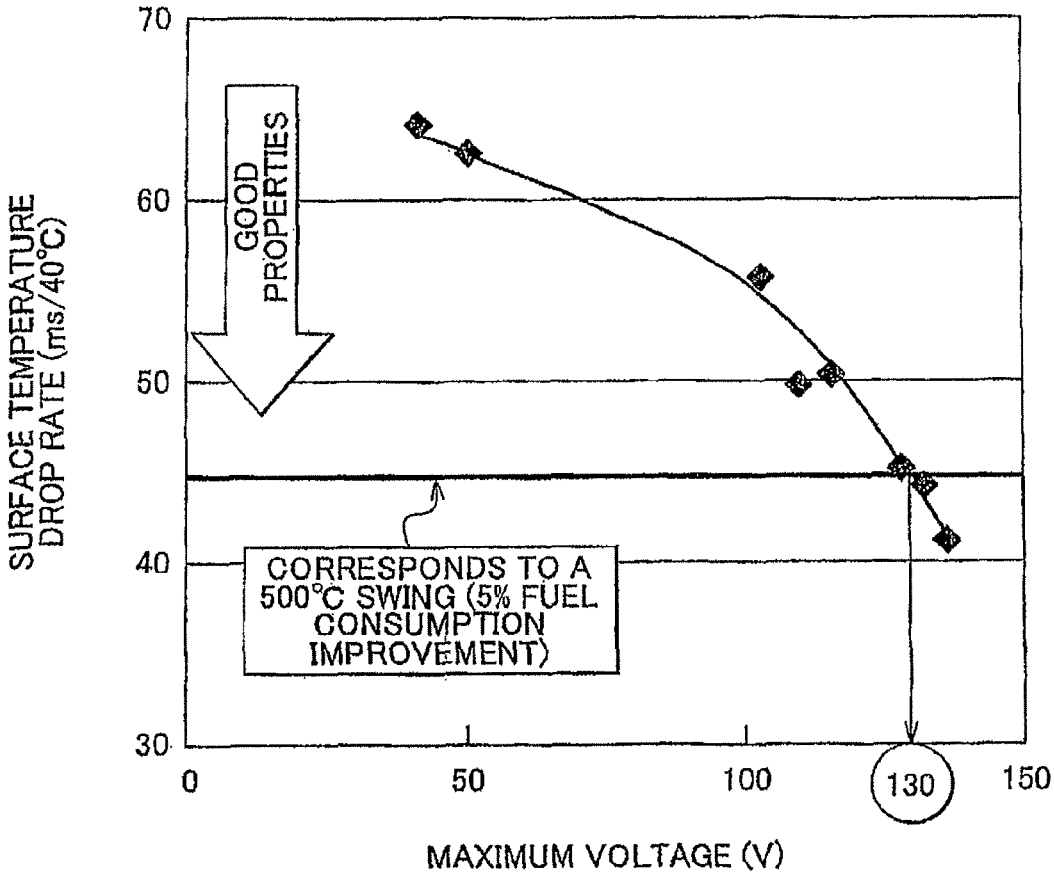
FIG. 17 is a graph of the experimental results that establish the lower limit for the maximum voltage range that satisfies the 40° C. drop time corresponding to a 5% fuel consumption improvement.

Given that from Table 6 and FIG. 17, 130 V is the maximum voltage at the intersection of the values measured for the surface temperature drop rate on the individual test pieces and the threshold value of 45 (ms/40° C.) for the surface temperature drop rate corresponding to a fuel consumption improvement of 5%, and that the properties are also excellent when the maximum voltage is at or above 130 V, these experiments provide the basis for the lower limit of 130 V for the applied voltage in the anodic oxidation treatment step. The 200 V upper limit for the applied voltage is based on the knowledge that the region above this 200 V is a plasma anodic oxidation region.

Experiments for identifying the relationship between the pore widening treatment time fox the anodic oxidation coating film and the porosity and surface temperature drop rate will be described, as will the results of these experiments. The inventors carried out experiments in order to identify the relationship between the pore widening treatment time and the porosity and surface temperature drop rate. Specifically, anodic oxidation treatments were carried out in the hard alumite region and the invention region as shown in FIG. 4; each of the resulting coating films was subjected to a pore widening treatment for a period of 0, 20, or 40 minutes; and the porosity and surface temperature drop time was measured on the resulting anodic oxidation coating films. The following are given in Table 7 below fox each of the test pieces: the conditions in the anodic oxidation treatment step and pore widening treatment step and the measured values fox the average coating film thickness, porosity, and surface temperature drop rate. A graph of the correlation between the pore widening treatment time and the porosity is given in FIG. 18A, while a graph of the correlation between the pore widening treatment time and the surface temperature drop rate is given in FIG. 18B, FIGS. 19A to 19C are SEM photographs of the surface of the coating film for anodic oxidation coating films produced by an anodic oxidation treatment step in the invention region and treated for a pore widening treatment time of, respectively, 0 minutes (no pore widening treatment), 20 minutes, and 40 minutes.

TABLE 7

| | conditions in the anodic oxidation treatment step | | | | | | conditions in the pore widening treatment step | | | avg. | | |
|---|---|---|---|---|---|---|---|---|---|---|---|---|
| anodic oxidation method | electrolytic bath | heat removal rate (cal/s/cm$^2$) | temperature (° C.) | maximum voltage (V) | current density (mA/cm$^2$) | treatment time (hr) | acid | temperature (° C.) | treatment time (min) | coating film thickness (μm) | porosity (%) | surface temperature drop rate (ms/40° C.) |
| invention region | 20° C. sulfuric acid | 1.9 | 0 | 130 | 90 | 60 | 5% phosphoric acid | 25 | 0 | 155 | 20.1 | 45 |
| hard region | 20° C. sulfuric acid | 2.6 | 0 | 50 | 10 | 120 | 5% phosphoric acid | 25 | 20 | 143 | 33.8 | 42 |
| | | | | | | | | | 40 | 136 | 41.3 | 46 |
| | | | | | | | | | 0 | 141 | 3.5 | — |
| | | | | | | | | | 20 | 131 | 7.0 | — |
| | | | | | | | | | 40 | 123 | 10.0 | — |

Figure 18A:
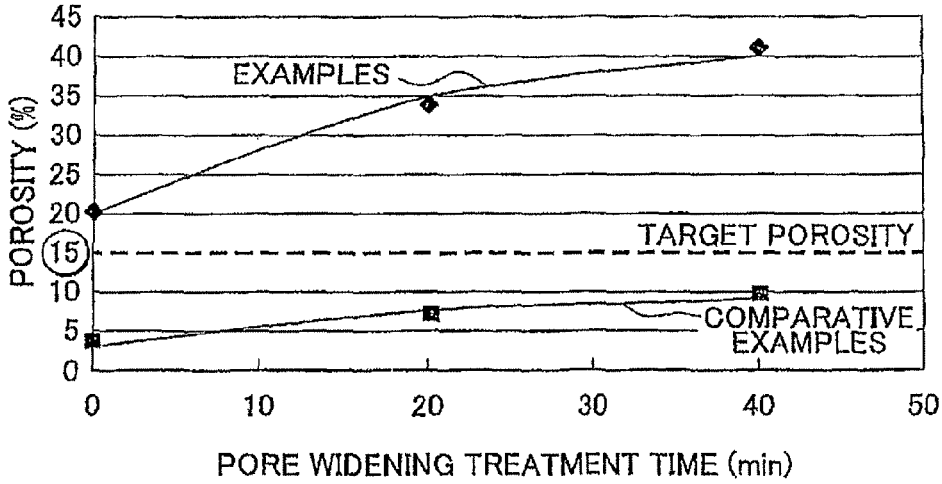
FIG. 18A is graph of the correlation in examples and comparative examples between the pore widening treatment time and porosity.
Figure 18B:
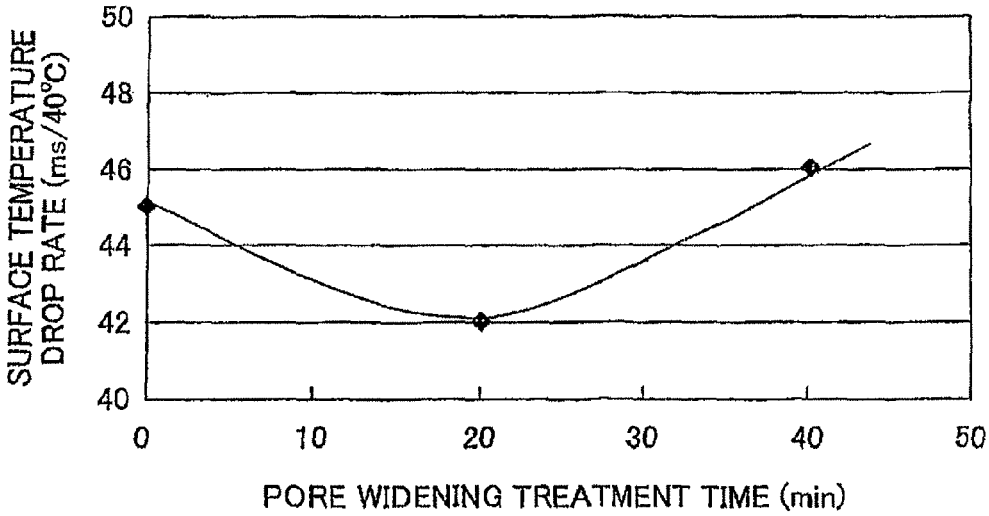
FIG. 18B is a graph of the correlation between the pore widening treatment time and the surface temperature drop rate.

According to Table 7 and FIG. 18A, the final coating films produced using an anodic oxidation treatment step in the invention range have a porosity of at least 20%. However, when the pore widening treatment is carried out for 40 minutes, the porosity slightly exceeds 40%, as shown by Table 7 and FIGS. 18A and 18B, and, since the surface temperature drop time also slightly exceeds 45 msec, it is demonstrated that the pore widening treatment is desirably carried out for less than 40 minutes.

Figure 19A:
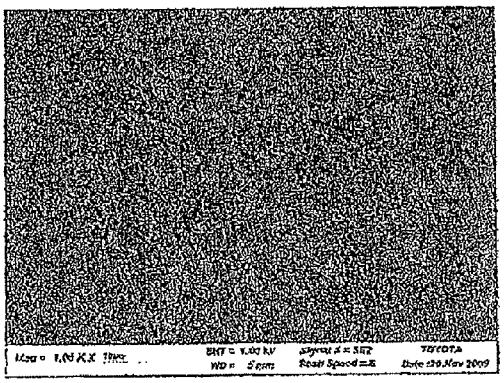
FIG. 19A is an SEM photograph of the surface of an anodic oxidation coating film in the absence of a pore widening treatment.
Figure 19B:
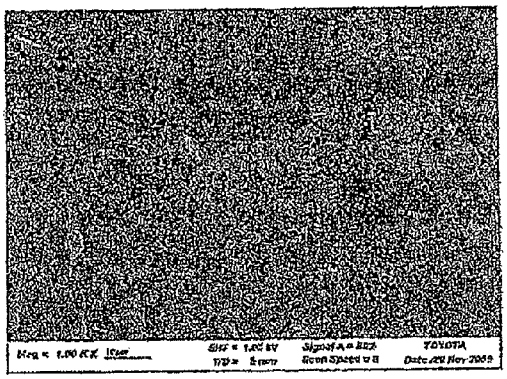
FIG. 19B is an SEM photograph of the surface of an anodic oxidation coating film when a 20 minute pore widening treatment has been carried out.
Figure 19C:
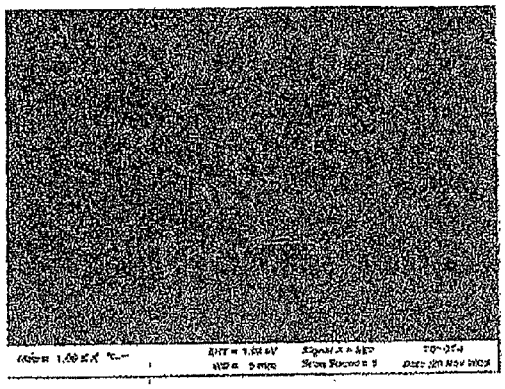
FIG. 19C is an SEM photograph of the surface of an anodic oxidation coating film when a 40 minute pore widening treatment has been carried out.
Figure 20:
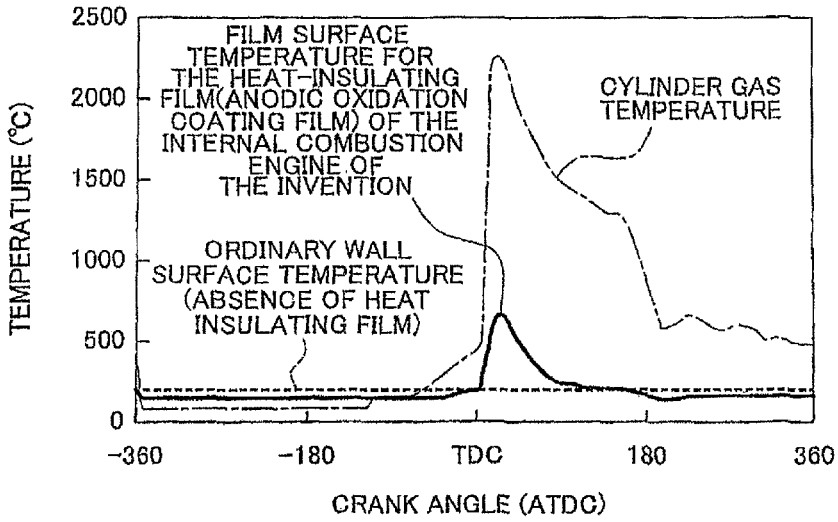
FIG. 20 is a graph supporting the explanation of the mechanism for the improved fuel consumption due to the formation, on the combustion chamber wall, of the low thermal conductivity low heat capacity heat-insulating film (anodic oxidation coating film) that constitutes the internal combustion engine of the invention, where the graph shows the cylinder gas temperature, the temperature of an ordinary wall surface, and the film surface temperature for the anodic oxidation coating film constituting the internal combustion engine of the invention, in each case as a function of the crank angle.

The SEM photographs in FIGS. 19A to 19C confirm the following: the pores in the coating film are inadequate in the photograph in FIG. 19A, where a pore widening treatment was, not carried out, while the pores in the coating film are too large in FIG. 19C (due to destruction of the porous structure), where a 40 minute pore widening treatment was performed; in contrast, in FIG. 19B, where a 20 minute pore widening treatment was performed, the coating film was provided with pores and also had a certain compactness because the cells were tied to each other.

Engine performance evaluation experiments with a diesel engine are described below, as are the results of these experiments. The inventors carried out the formation of an alumite coating film, using the conditions described below, on only the top surface of the piston in the combustion chamber of the engine and measured the engine performance, e.g., the fuel consumption improvement and $NO_x$ change.

The engine used here has the following specifications: water-cooled horizontal single-cylinder DI diesel engine, ϕ 78×80 (382 cc), 5.1 kW @ 2600 rpm. The specifications for the alumite are as follows: film thickness=150 μm (after the sealing treatment: boiling water treatment), porosity corresponding to 15%. The alumite-treated article was the front (only the piston side of the combustion chamber) of the top of the diesel piston, and an aluznite treatment was not performed on the other members facing the combustion chamber, e.g., the cylinder bead, valves, and cylinder block.

Three parameters indicative of engine performance were measured with the following results: the fuel consumption was raised (improved) by 1.3%, the smoke change was a decrease of 29%, and the $NO_x$ change was a decrease of 4%.

The inventors estimate that an approximately 2.5-times larger fuel consumption improvement could be achieved for the formation of the same alumite coating Mira over the entire wall surface versus formation of the alumite coating film only on the piston top surface among the wall surfaces facing the combustion chamber of the diesel engine. In addition, the inventors estimate that an approximately 1.6-fold increase in the fuel consumption improvement would be recognized by the formation of the same coating film in a supercharger-equipped diesel engine over that for the non-supercharged (natural intake) DI diesel engine described above. Accordingly, a 5% improvement in fuel consumption can be achieved for the formation of the coating film that is the structural element of the invention over the entire combustion chamber of a supercharger-equipped direct-injection diesel engine.

Embodiments of the invention have been particularly described above using the drawings, but the specific structure is not limited to these embodiments, and design variations, workshop modifications, and so forth, that do not depart from the essential features of the invention are encompassed by the invention.

The invention claimed is:

1. An internal combustion engine, comprising:

an anodic oxidation coating film formed on all or a portion of a wall facing a combustion chamber of the internal combustion engine, the anodic oxidation coating film having a structure provided with a bonding region and a nonbonding region, each of hollow cells forming the coating film in the bonding region being bonded to the adjacent hollow cells, and three or more adjacent hollow cells in the nonbonding region being not bonded to each other, and a porosity of the anodic oxidation coating film in the anode oxidation coating film being determined by a first void present in the hollow cell and a second void forming the nonbonding region.

2. The internal combustion engine according to claim 1, wherein the thickness of the anodic oxidation coating film is in the range from 100 to 500 μm.

3. The internal combustion engine according to claim 1, wherein the porosity is in the range from 15 to 40%.

4. The internal combustion engine according to claim 1, wherein the ratio ϕ/d, where ϕ is an average pore diameter of the first void present in the hollow cell and d is an average cell diameter of the hollow cell, is in the range from 0.3 to 0.6.

5. The internal combustion engine according to claim 1, wherein the surface of the anodic oxidation coating film has been subjected to a sealing treatment with boiling water or steam or to a coating treatment with a thin film that lacks pores or to both treatments.

6. The internal combustion engine according to claim 5, wherein the thin film comprises an inorganic sealant.

7. The internal combustion engine according to claim 1, wherein the anodic oxidation coating film is an alumite coating film.

8. The internal combustion engine according to claim 7, wherein the microVickers hardness of the anodic oxidation coating film is in the range from 110 to 400 HV0.025.

9. A method of producing an internal combustion engine by forming an anodic oxidation coating film on all or a portion of a wall facing a combustion chamber in the internal combustion engine, comprising:

forming an anode by immersing all or a portion of the wall in an acidic electrolytic bath, forming a cathode within the acidic electrolytic bath, and then applying between the two electrodes a voltage adjusted to the range of 130 to 200 V for the maximum, and performing electrolysis at a heat removal rate adjusted to the range from 1.6 to 2.4 cal/s/cm$^2$; and producing, on the surface of all or a portion of the wall, an anodic oxidation coating film having a structure provided with a bonding region and a nonbonding region, each of hollow cells in the bonding region being bonded to the adjacent hollow cells, and three or more adjacent hollow cells in the nonbonding region being not bonded to each other.

10. The method of producing an internal combustion engine according to claim 9, further comprising:

a first step of forming an intermediate of the anodic oxidation coating film; and a second step of adjusting a porosity determined by a first void present in the hollow cell and a second void forming the nonbonding region, by widening voids of the intermediate of the anodic oxidation coating film by carrying out a pore widening treatment using acid on all or a portion of the wall provided on the surface of the intermediate of the anodic oxidation coating film.

11. The method of producing an internal combustion engine according to claim 9, wherein the temperature of the acidic electrolyte is adjusted to the range from −5 to 5° C.

12. The method of producing an internal combustion engine according to claim 9, wherein the thickness of the anodic oxidation coating film is adjusted to the range from 100 to 500 μm.

13. The method of producing an internal combustion engine according to claim 9, further comprising:

a step of performing, after the formation of the anodic oxidation coating film, a sealing treatment with boiling water or steam or a coating treatment with a thin film that lacks pores or both treatments.

14. The method of producing an internal combustion engine according to claim 13, characterized in that the thin film comprises an inorganic sealant.

15. The method of producing an internal combustion engine according to claim 9, wherein the anodic oxidation coating film is an alumite coating film.

* * * * *